US008815483B2

(12) United States Patent
Matsumoto et al.

(10) Patent No.: US 8,815,483 B2
(45) Date of Patent: Aug. 26, 2014

(54) MAGENTA TONER, TONER SET, MAGENTA DEVELOPER, TONER CARTRIDGE, PROCESS CARTRIDGE, AND IMAGE FORMING APPARATUS

(75) Inventors: Akira Matsumoto, Kanagawa (JP); Yusuke Ikeda, Kanagawa (JP); Eiji Nakai, Kanagawa (JP)

(73) Assignee: Fuji Xerox., Ltd., Tokyo (JP)

( * ) Notice: Subject to any disclaimer, the term of this patent is extended or adjusted under 35 U.S.C. 154(b) by 61 days.

(21) Appl. No.: 13/223,757

(22) Filed: Sep. 1, 2011

(65) Prior Publication Data

US 2012/0183894 A1 Jul. 19, 2012

(30) Foreign Application Priority Data

Jan. 17, 2011 (JP) ..... 2011-006904

(51) Int. Cl.

| | |
|---|---|
| ***G03G 9/09*** | (2006.01) |
| ***G03G 9/087*** | (2006.01) |
| ***G03G 15/08*** | (2006.01) |

(52) U.S. Cl.

CPC ..... *G03G 15/08* (2013.01); *G03G 9/08795* (2013.01); *G03G 9/08791* (2013.01); *G03G 9/08755* (2013.01); *G03G 9/092* (2013.01); *G03G 9/091* (2013.01); *G03G 9/08786* (2013.01); *G03G 9/0914* (2013.01); *G03G 9/08797* (2013.01); *G03G 9/08782* (2013.01)

USPC ..... 430/108.2; 430/107.1; 430/108.1; 430/109.1; 430/109.4; 399/222

(58) Field of Classification Search

CPC ..... G03G 9/092; G03G 9/08755; G03G 9/08782; G03G 9/08791; G03G 15/08

USPC ..... 430/107.1, 108.1, 108.2, 109.1, 109.4; 399/222

See application file for complete search history.

(56) References Cited

U.S. PATENT DOCUMENTS

| | | | | |
|---|---|---|---|---|
| 5,811,213 | A * | 9/1998 | Chiba | 430/108.1 |
| 6,117,605 | A * | 9/2000 | Chiba | 430/108.21 |
| 2009/0162762 | A1* | 6/2009 | Maehata et al. | 430/48 |
| 2009/0233210 | A1* | 9/2009 | Ninomiya et al. | 430/109.4 |
| 2010/0081075 | A1* | 4/2010 | Watanabe et al. | 430/108.21 |
| 2010/0151377 | A1* | 6/2010 | Uchino et al. | 430/110.2 |
| 2010/0248119 | A1* | 9/2010 | Young et al. | 430/108.2 |

FOREIGN PATENT DOCUMENTS

| | | |
|---|---|---|
| JP | A-10-123760 | 5/1998 |
| JP | A-11-84735 | 3/1999 |
| JP | A-2004-61686 | 2/2004 |

* cited by examiner

*Primary Examiner* — Peter Vajda
(74) *Attorney, Agent, or Firm* — Oliff PLC

(57) ABSTRACT

A magenta toner includes a binder resin containing a polyester resin having a dodecenylsuccinic acid structure as a constituent unit, and a solid solution of C.I. Pigment Violet 19 and C.I. Pigment Red 122, the magenta toner having an amount of the solid solution of from 2% by mass to 30% by mass based on the total mass of the toner.

14 Claims, 2 Drawing Sheets

MAGENTA TONER, TONER SET, MAGENTA DEVELOPER, TONER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2011-006904 filed Jan. 17, 2011.

BACKGROUND

1. Technical Field

The present invention relates to a magenta toner, a toner set, a magenta developer, a toner cartridge, a process cartridge, and an image forming apparatus.

2. Related Art

Methods for visualizing (developing) image information through electrostatic latent images, such as an electrophotographic method, are currently used in a variety of fields. In an electrophotographic method, for example, an electrostatic latent image is formed on the surface of an electrostatic latent image holding member by the processes of charging and exposure (electrostatic latent image forming step), a toner is supplied thereto to develop the electrostatic latent image (developing step), the developed toner image is transferred to a recording medium with or without the use of an intermediate transfer member (transfer step), the transfer image thus transferred is fixed (fixing step), and thus image information is visualized.

In the case of forming a color image in the electrophotographic method, generally, color reproduction is achieved by using toners of the three primary colors of coloring materials, such as a combination of yellow, magenta and cyan, or using toners of four colors, such as the three primary colors and black. In this case, a secondary color, for example, a blue image is formed as a cyan toner and a magenta toner are laminated at an appropriate proportion.

SUMMARY

According to an aspect of the invention, there is provided a magenta toner including a binder resin containing a polyester resin having a dodecenylsuccinic acid structure as a constituent unit, and a solid solution of C.I. Pigment Violet 19 and C.I. Pigment Red 122, the magenta toner having an amount of the solid solution of from 2% by mass to 30% by mass based on the total mass of the toner.

BRIEF DESCRIPTION OF THE DRAWINGS

Exemplary embodiments of the present invention will be described in detail based on the following figures, wherein.

DETAILED DESCRIPTION

Figure 1:
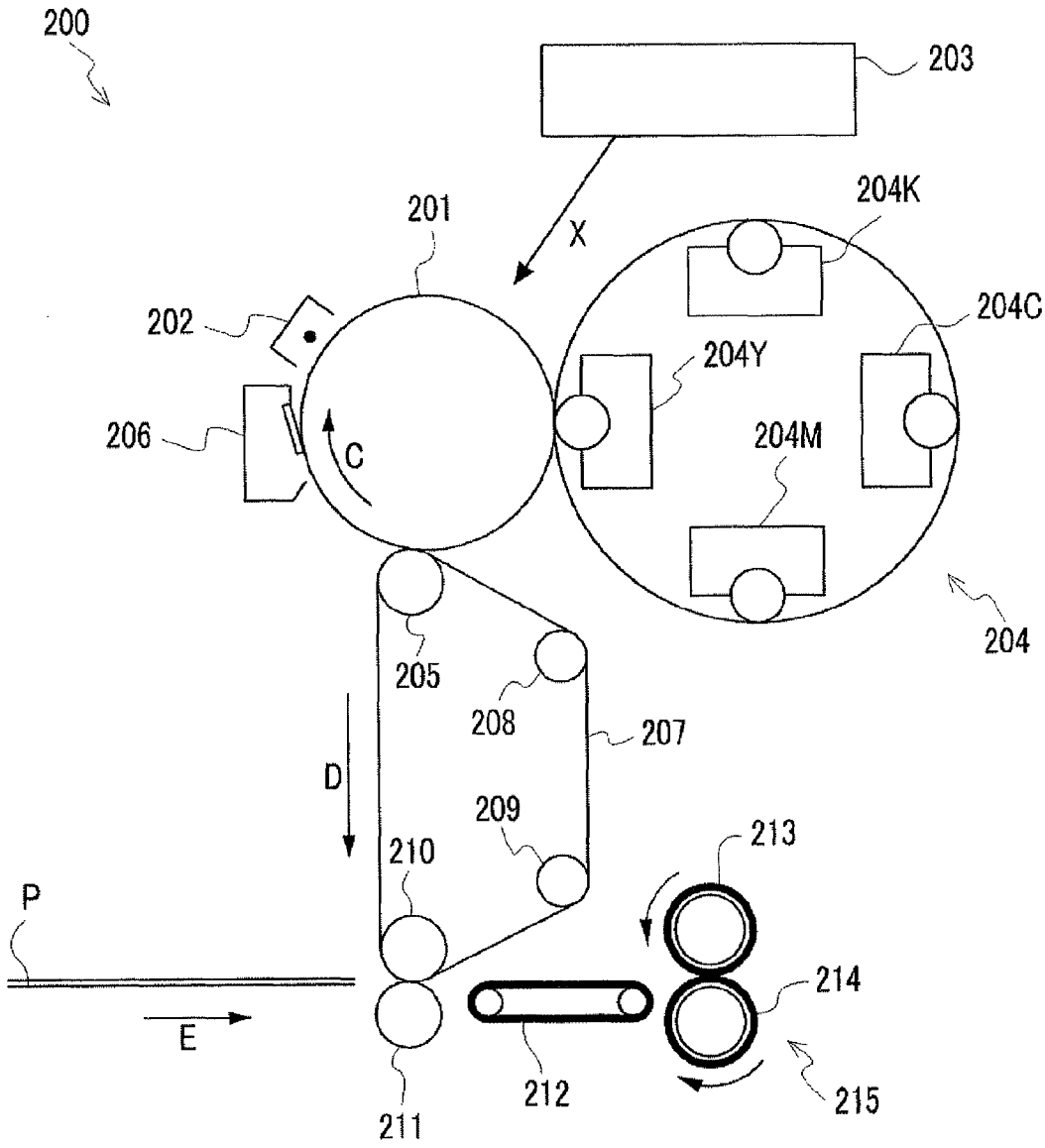
FIG. 1 is a schematic configuration diagram showing an image forming apparatus according to an exemplary embodiment of the invention.

Hereinafter, exemplary embodiments of the magenta toner, toner set, magenta developer, toner cartridge, process cartridge, and image forming apparatus according to the invention will be described in detail.

<Magenta Toner>

The magenta toner according to an exemplary embodiment of the invention is a toner containing a binder resin which includes a polyester resin having a dodecenylsuccinic acid structure as a constituent unit, and a solid solution of C.I. Pigment Violet 19 and C.I. Pigment Red 122, and the amount of the solid solution based on the total mass of the toner is from 2% by mass to 30% by mass (or from about 2% by mass to about 30% by mass).

The magenta toner according to the exemplary embodiment of the invention is desirably a magenta toner produced in an aqueous medium.

Pigments having a quinacridone skeleton, such as C.I. Pigment Violet 19 and C.I. Pigment Red 122, have a broad reproducible color gamut in the blue region, and are widely used for the use in inkjet ink or toner. Particularly, a solid solution of C.I. Pigment Violet 19 and C.I. Pigment Red 122 is known to have a broad reproducible color gamut in the blue region. However, the quinacridone skeleton itself is less polar and highly hydrophobic, and in addition, C.I. Pigment Violet 19 and C.I. Pigment Red 122 that are structurally similar to each other are mixed at the molecular level so that their polarities are cancelled by each other. Therefore, a solid solution of C.I. Pigment Violet 19 and C.I. Pigment Red 122 has poor compatibility with polyester resins having high polarity, and the pigments aggregate, thereby deteriorating the reproducibility of blue color.

Since the magenta toner according to the exemplary embodiment of the invention uses a binder resin which includes a polyester resin having a dodecenylsuccinic acid structure as a constituent unit, aggregation of the solid solution that is used as the coloring pigment is suppressed, and the reproducible color gamut in the blue region is extended.

The magenta toner according to the exemplary embodiment of the invention contains toner particles that contain a colorant, a binder resin, and a release agent that is used as necessary. In the following description, the respective components constituting the toner particles will be described, and a method for production, a toner with an externally added additive (hereinafter, may be simply referred to as "toner"), and the properties of the toner particles or the toner will be described.

(Colorant)

The magenta toner of the exemplary embodiment of the invention contains a solid solution of C.I. Pigment Violet 19 and C.I. Pigment Red 122 (hereinafter, may be referred to a specific solid solution) as a colorant.

The amount of the specific solid solution that is used as a colorant based on the total mass of the toner is considered to be from 2% by mass to 30% by mass. Since the amount of the specific solid solution based on the total mass of the toner is from 2% by mass to 30% by mass, high coloring power and chromaticity are obtained.

If the amount of the specific solid solution based on the total mass of the toner is less than 2% by mass, a problem of insufficient image density may occur on occasion. If the amount of the specific solid solution based on the total mass of the toner is greater than 30% by mass, the pigment molecules aggregate so that a problem of insufficient chromaticity may occur. The amount of the specific solid solution based on the total mass of the toner is desirably in the range of from 5% by mass to 20% by mass, and more desirably in the range of from 7% by mass to 15% by mass.

The term total mass of the toner as used in the exemplary embodiment of the invention refers to the mass of the so-called toner particles excluding the externally added additive.

The ratio (mass basis) of C.I. Pigment Violet 19 and C.I. Pigment Red 122 contained in the specific solid solution used in the exemplary embodiment of the invention is desirably 80:20 to 20:80, and more desirably 60:40 to 40:60.

It is desirable that the magenta toner of the exemplary embodiment of the invention further contain the specific solid solution, C.I. Pigment Red 238 or C.I. Pigment Red 269, in addition to the specific solid solution. When the magenta toner further contains these colorants in addition to the specific solid solution, the reproducible color gamut in the red region is extended in addition to the reproducible color gamut in the blue region.

The amount of C.I. Pigment Red 238 or C.I. Pigment Red 269 is desirably from 30 parts to 500 parts (or from about 30 parts to about 500 parts), and more desirably from 50 parts to 200 parts (or from about 50 parts to about 200 parts), based on 100 parts of the solid solution of C.I. Pigment Violet 19 and C.I. Pigment Red 122.

The ratio of C.I. Pigment Violet 19 to C.I. Pigment Red 122 to C.I. Pigment Red 238 or C.I. Pigment Red 269 may be 4 to 6:4 to 6:5 to 20.

The method for preparing the specific solid solution is not particularly limited, but examples include a method of simultaneously recrystallizing the solid solution components described in U.S. Pat. No. 3,160,510 from sulfuric acid or an appropriate solvent, (after salt grinding), and subsequently solvent treating the crystals; and a method of cyclizing an appropriately substituted diaminoterephthalic acid mixture described in German Patent No. 1217333, and then solvent treating the product.

In the magenta toner of the exemplary embodiment of the invention, other pigments or dyes, extender pigments and the like may also be added into the colorant, in addition to the specific solid solution, according to the purpose of use. The proportion of the specific solid solution is preferably 60% by mass or greater, and more preferably 80% by mass or greater, based on the total amount of the colorant, and it is most desirable that the entirety of the colorant be composed of the specific solid solution. When the proportion of the specific solid solution is 60% by mass or greater based on the total amount of the colorant, even if two or more kinds of colorants are mixed, clouding of the color does not occur, and the specific solid solution may have the benefit of excellent color developability.

Examples of the pigment that may be used in mixture with the specific solid solution include common pigments of yellow, orange, red and magenta colors. Examples of the extender pigments that may be used in mixture with the specific solid solution include powdered barite, barium carbonate, clay, silica, white carbon, talc, and alumina white. However, since extender pigments often impair transparency, mixed use of the extender pigments is not desirable.

Furthermore, examples of the dyes that may be used in mixture with the specific solid solution include various dyes such as basic dyes, acidic dyes, disperse dyes and direct dyes, for example, nigrosin, methylene blue, Rose Bengal, quinoline yellow, and ultramarine blue. These dyes may be used individually or as mixtures, and the dyes may also be used in the form of a solid solution. In the case of using a wet preparation method, an oil-soluble dye is desirable from the viewpoint of preventing the dye from escaping to the aqueous phase. Furthermore, it is desirable to use a dye after subjecting the dye to a chemical hydrophobization treatment or to encapsulation with a polymer.

The dispersion particle size of the colorant in the magenta toner according to the exemplary embodiment of the invention is preferably in the range of from 30 nm to 300 nm, and more preferably in the range of from 60 nm to 200 nm. When the dispersion particle size is 30 nm or larger, the toner does not undergo conspicuous thickening. Furthermore, when the dispersion particle size is 300 nm or less, the pigment is not exposed to the toner surface, and therefore, the amount of charging of the toner does not decrease.

(Binder Resin)

The magenta toner of the exemplary embodiment of the invention contains, as a binder resin, a polyester resin having a dodecenylsuccinic acid structure as a constituent unit.

—Dodecenylsuccinic Acid Structure—

The "dodecenylsuccinic acid structure" is a constituent unit in the state in which two hydrogen atoms of two carboxyl groups in dodecenylsuccinic acid are extracted, and is represented by the following structural formula.

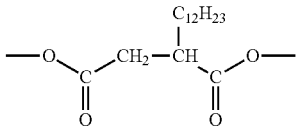

The functional group represented by the formula: $C_{12}H_{23}$ is a dodecenyl group, and contains one carbon-carbon double bond in the straight chain structure having 12 carbon atoms. The position of the double bond is not specifically defined, and the double bond may be at any position.

The dodecenylsuccinic acid structure is present as a copolymerization unit in the state of being incorporated into the skeleton of the polyester resin that will be described below. The copolymerization ratio is preferably in the range of from 3 mol % to 30 mol %, more preferably in the range of from 5 mol % to 25 mol %, and even more preferably in the range of from 7 mol % to 20 mol %, based on 100 mol % of all acid-derived components of the polyester resin. When the copolymerization ratio is 3 mol % or greater, satisfactory dispersibility of the colorant is obtained. Furthermore, when the copolymerization ratio is 30 mol % or less, the resin is prevented from being colored brown.

The dodecenylsuccinic acid structure may be copolymerized by allowing dodecenylsuccinic acid or an anhydride thereof to be present together with the synthesis raw material of the polyester resin at the time of synthesis of the polyester resin, and thereby incorporating the dodecenylsuccinic acid structure into the skeleton of the polyester resin.

—Polyester Resin—

It is desirable that the binder resin of the magenta toner of the exemplary embodiment of the invention be formed from a polyester resin having a dodecenylsuccinic acid structure as a primary constituent unit (hereinafter, may be simply referred to as "specific polyester resin"). The amount of the specific polyester resin in the total amount of the binder resin is preferably 60% by mass or greater, and more preferably 80% by mass or greater. When the amount of the specific polyester resin is 60% by mass or greater, the binder resin may have the properties characteristic to the polyester resin sufficiently.

Examples of the specific polyester resin include products obtainable by polycondensation of polyvalent carboxylic acids containing dodecenylsuccinic acid and polyols.

Examples of polyvalent carboxylic acids other than dodecenylsuccinic acid include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenylsuccinic anhydride, and adipic acid; and alicyclic carboxylic acids such as cyclohexanedicarboxylic acid, and these polyvalent carboxylic acids may be used individually or as mixtures of two or more kinds. In order to secure satisfactory fixability, it is desirable to introduce a cross-linked structure or a branched structure into the specific polyester resin, and for that purpose, it is desirable to use a trivalent or higher-valent carboxylic acid (trimellitic acid or anhydride thereof) in combination with a dicarboxylic acid.

Examples of the polyols in the specific polyester resin include aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic diols such as ethylene oxide adducts of bisphenol A, and propylene oxide adducts of bisphenol A. These polyols may be used individually or as mixtures of two or more kinds. Among these polyols, aromatic diols and alicyclic diols are desirable, and among others, aromatic dials are more desirable. Furthermore, in order to secure more satisfactory fixability, it is desirable to introduce a cross-linked structure or a branched structure into the specific polyester resin, and for this purpose, a trivalent or higher-valent polyol (glycerin, trimethylolpropane, or pentaerythritol) may be used in combination with a diol.

In regard to the method for synthesis of the specific polyester resin (polymerization temperature, molar ratio between the acid components and the alcohol components, catalyst that may be used, and the like), the same terms as those that will be described in conjunction with the crystalline polyester resin that will be described below apply.

Examples of the resin that may be used as the binder resin in addition to the polyester resin include amorphous resins such as homopolymers or copolymers of monoolefins such as ethylene, propylene, butylene, and isoprene; vinyl esters such as vinyl acetate, vinyl propionate, vinyl benzoate, and vinyl butyrate; α-methylene aliphatic monocarboxylic acid esters such as methyl acrylate, phenyl acrylate, octyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone. Among these, particularly, representative examples of the binder resin include polystyrene, a styrene-alkyl acrylate copolymer, a styrene-butadiene copolymer, a styrene-maleic anhydride copolymer, polyethylene, and polypropylene. Further examples include polyurethane, an epoxy resin, a silicone resin, polyamide, and modified rosin.

Furthermore, the binder resin desirably includes a crystalline resin having crystallinity, and may include a crystalline resin and an amorphous resin. It is desirable that the binder resin be an amorphous specific polyester resin and a crystalline resin.

When the binder resin includes a crystalline resin, the content of the crystalline resin in the toner binder resin is desirably in the range of from 1% by mass to 10% by mass, more desirably in the range of from 1% by mass to 9% by mass, and even more desirably in the range of from 2% by mass to 8% by mass. When the content is 1% by mass or greater, heat absorption by the crystalline resin occurs sufficiently during fixing, and the effect of using a crystalline resin is obtained. When the content is 10% by mass or less, the domain of the crystalline resin in the toner is not enlarged, and an increase in the number of domains is suppressed, so that the images thus formed obtain satisfactory transparency.

The content of the crystalline resin in the binder resin of the toner is calculated by the method described below.

First, the toner is dissolved in methyl ethyl ketone (MEK) at normal temperature (from 20° C. to 25° C.). This is because, for example, when a crystalline resin such as crystalline polyester and an amorphous resin are included in the toner, practically only the amorphous resin dissolves in MEK at normal temperature. Therefore, since the MEK-soluble fraction includes the amorphous resin, the amorphous resin is obtained from the supernatant separated through centrifugation after the dissolution. Meanwhile, the solids fraction obtained after the centrifugation is heated to 65° C. for 60 minutes, and is dissolved in MEK. This is filtered through a glass filter at 60° C., and thereby the crystalline resin such as crystalline polyester is obtained from the filter cake. During this operation, if the temperature decreases in the middle of filtration, the crystalline resin may precipitate out. Therefore, the operation is carried out rapidly so that the temperature does not drop, and in a heat-retained state. The amount of the crystalline resin thus obtained is measured, and thereby the content of the crystalline resin is determined.

According to the exemplary embodiment of the invention, the term "crystalline" of the crystalline resin means that in a differential scanning calorimetric analysis (DSC) of the resin, the resin does not have a stepwise change in the heat absorption, but has a clearly defined heat absorption peak during the stage of temperature increase, and also has a clearly defined exothermic peak during the stage of temperature decrease. Specifically, in a differential scanning calorimetric analysis (DSC) using a differential scanning calorimeter (apparatus name: DSC-60 type) manufactured by Shimadzu Corp., when the temperature is increased from 0° C. to 150° C. at a rate of 10° C./min, the temperature is maintained at 150° C. for 5 minutes, the temperature is decreased to 0° C. at a rate of −10° C./min, the temperature is maintained at 0° C. for 5 minutes, and then the temperature is increased again to 150° C. at a rate of 10° C./min, if the heat absorption is 25 J/g or greater in the second temperature increase spectrum, this is defined as a "clear" endothermic peak. On the other hand, when the temperature from the onset point in the stage of temperature decrease to the peak top of the exothermic peak is 15° C. or less, and the calorific value is 25 J/g or greater, this is defined as a "clear" exothermic peak.

Furthermore, from the viewpoint of sharp melting properties, the temperature from the onset point to the peak top of the endothermic peak is preferably 15° C. or lower, and more preferably 10° C. or lower. An arbitrary point at a flat area of the baseline in the DSC curve, and the point where the value obtained by differentiating the spectrum curve from the baseline to the falling peak top, is a maximum (point where the gradient of the spectrum is the steepest) are defined, and the intersection between the tangent lines at the two points is designated as the "onset point." In the case of a toner, the endothermic peak may represent a peak having a width of from 40° C. to 50° C. on occasion.

On the other hand, the "amorphous resin" used as the binder resin refers to a resin which does not correspond to the crystalline resin. Specifically, in a differential scanning calorimetric analysis (DSC) using a differential scanning calorimeter (apparatus name: DSC-60 type) manufactured by Shimadzu Corp., when the temperature from the onset point to the peak top of the endothermic peak during a temperature increase at a rate of temperature increase of 10° C./min is greater than 15° C., or when a clearly defined endothermic peak is not recognized, or when a clearly defined exothermic peak is not recognized during the temperature decrease, the resin is considered as "amorphous." The method for determining the "onset point" in a DSC curve is the same as in the case of the "crystalline resin."

Specific examples of the crystalline resin include a crystalline polyester resin and a crystalline vinyl-based resin, but from the viewpoints of adhesiveness to paper at the time of fixing, chargeability, and adjustment of the melting temperature to a desirable range, a crystalline polyester resin is desirable. Furthermore, an aliphatic crystalline polyester resin having an appropriate melting temperature is more desirable.

Examples of the crystalline vinyl-based resin include vinyl-based resins using (meth)acrylic acid esters of long-chain alkyls and alkenyls, such as amyl (meth)acrylate, hexyl (meth)acrylate, heptyl (meth)acrylate, octyl (meth)acrylate, nonyl (meth)acrylate, decyl (meth)acrylate, undecyl (meth) acrylate, tridecyl (meth)acrylate, myristyl (meth)acrylate, cetyl (meth)acrylate, stearyl (meth)acrylate, oleyl (meth) acrylate, and behenyl (meth)acrylate. The term "(meth)acryl" as used herein means both "acryl" and "methacryl."

—Crystalline Polyester Resin—

The crystalline polyester resin is synthesized from a divalent acid (dicarboxylic acid) component and a dihydric alcohol (diol) component, and the "crystalline polyester resin" refers to a resin which does not have a stepwise change in heat adsorption, but a clearly defined endothermic peak in a differential scanning calorimetric analysis (DSC). Furthermore, in the case of a polymer obtained by copolymerizing another component in the main chain of the crystalline polyester resin, when the proportion of the other component is 50% by mass or less, this copolymer is also called a crystalline polyester resin.

Various dicarboxylic acids may be used as an acid forming an acid-derived constituent unit in the crystalline polyester resin, but the dicarboxylic acid as the acid-derived constituent unit is not limited to one kind, and two or more kinds of dicarboxylic acid-derived constituent units may be included. The dicarboxylic acid may contain a sulfonic acid group so as to make the emulsifiability satisfactory in an emulsion aggregation method.

The term "acid-derived constituent unit" refers to a constituent unit which is an acid component before the synthesis of the polyester resin, and the term "alcohol-derived constituent unit" that will be described below refers to a constituent unit which is an alcohol component before the synthesis of the polyester resin.

The dicarboxylic acid is desirably an aliphatic dicarboxylic acid, and particularly a linear carboxylic acid is suitable. Examples of the linear carboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanediol, 1,14-tetradecanediol, 1,18-octadecanediol, 1,20-eicosanediol, and lower alkyl esters or acid anhydrides thereof.

Among them, the linear carboxylic acid is desirably an acid having from 6 to 10 carbon atoms. In order to increase crystallinity, it is desirable to use these linear type dicarboxylic acids in an amount of 95 constituent mol % or more, and more desirably in an amount of 98 constituent mol % or more, of the acid-derived constituent units. The term "constituent mol %" refers to the percentage obtained by considering the various constituent units (acid-derived constituent units, and alcohol-derived constituent units) in the polyester resin respectively as one unit (mole).

The acid-derived constituent unit may also include constituent components such as a constituent unit derived from a dicarboxylic acid having a sulfonic acid group, in addition to the aliphatic dicarboxylic acid-derived constituent unit described above.

The alcohol for constituting an alcohol-derived constituent unit in the crystalline polyester resin is desirably an aliphatic dialcohol, and examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol. Among them, dialcohols having from 2 to carbon atoms are desirable. In order to increase crystallinity, it is desirable to use these linear type dialcohols in an amount of 95 mol % or more, and more desirably in an amount of 98 mol % or more, of the alcohol-derived constituent units.

Examples of other dihydric dialcohols include bisphenol A, hydrogenated bisphenol A, ethylene oxide and/or propylene oxide adduct of bisphenol A, 1,4-cyclohexanediol, 1,4-cyclohexanedimethanol, diethylene glycol, propylene glycol, dipropylene glycol, 1,3-butanediol, and neopentyl glycol. These may be used individually, or two or more kinds may be used in combination.

In addition, if necessary, monovalent acids such as acetic acid and benzoic acid; monohydric alcohols such as cyclohexanol and benzyl alcohol; trivalent or higher-valent acids such as benzenetricarboxylic acid, and naphthalenetricarboxylic acid; and anhydrides thereof or lower alkyl esters thereof; and trihydric or higher-hydric alcohols such as glycerine, trimethylolethane, trimethylolpropane, and pentaerythritol may also be used in combination.

There are no particular limitations on other monomers, and conventionally known divalent carboxylic acids and dihydric alcohols may be used. Specific examples of these monomer components include, as divalent carboxylic acids, for example, dibasic acids such as phthalic acid, isophthalic acid, terephthalic acid, naphthalene-2,6-dicarboxylic acid, naphthalene-2,7-dicarboxylic acid, and cyclohexanedicarboxylic acid; and anhydrides thereof or lower alkyl esters thereof. These may be used individually, or two or more kinds may be used in combination.

The crystalline polyester resin may be synthesized by using a conventionally known method, with any combination of the monomer components described above, and a transesterification method or a direct polycondensation method may be used individually or in combination.

Specifically, polymerization may be carried out at a polymerization temperature of from 140° C. to 270° C., and if necessary, the pressure inside the reaction system may be reduced, and the reaction is carried out while removing the water or alcohol generated at the time of condensation. When the monomers are not soluble or compatible at the reaction temperature, a high boiling point solvent may be added as a dissolution aid solvent to dissolve the monomers. During the polycondensation reaction, it is desirable to carry out the reaction while distilling off the dissolution aid solvent. If a monomer having poor compatibility is present in the copolymerization reaction, the monomer having poor compatibility is condensed in advance with an acid or an alcohol that is expected to be polycondensed with the monomer, and then the product may be subjected to polycondensation together with the main component.

The molar ratio used to react the acid component and the alcohol component (acid component/alcohol component) may vary with the reaction conditions and the like, and therefore, the molar ratio may not be defined briefly. However, in the case of direct polycondensation, the molar ratio is usually preferably 0.9/1.0 to 1.0/0.9. In the case of the transesterification reaction, a monomer that may be removed by distillation in vacuo, such as ethylene glycol, propylene glycol, neopentyl glycol, or cyclohexanedimethanol, may be used in excess.

Examples of the catalyst that may be used at the time of production of the crystalline polyester resin include titanium aliphatic carboxylates, such as titanium aliphatic monocarboxylyates such as titanium acetate, titanium propionate, titanium hexanoate, and titanium octanoate; titanium aliphatic dicarboxylates such as titanium oxalate, titanium succinate, titanium maleate, titanium adipate, and titanium sebacate; titanium aliphatic tricarboxylates such as titanium hexanetricarboxylate, and titanium isooctanetricarboxylate; and titanium aliphatic polycarboxylates such as titanium octanetetracarboxylate and titanium decanetetracarboxylate; titanium aromatic carboxylates, such as titanium aromatic monocarboxylates such as titanium benzoate; titanium aromatic dicarboxylates such as titanium phthalate, titanium terephthalate, titanium isophthalate, titanium naphthalenedicarboxylate, titanium biphenyldicarboxylate, and titanium anthracenedicarboxylate; titanium aromatic tricarboxylates such as titanium trimellitate, and titanium naphthalenetricarboxylate; and titanium aromatic tetracarboxylates such as titanium benzenetetracarboxylate, and titanium naphthalenetetracarboxylate; titanyl compounds of titanium aliphatic carboxylates or titanium aromatic carboxylates, and alkali metal salts thereof; halogenated titanium compounds such as dichlorotitanium, trichlorotitanium, tetrachlorotitanium, and tetrabromotitanium; tetraalkoxytitaniums such as tetrabutoxytitanium (titanium tetrabutoxide), tetraoctoxytitanium, and tetrastearyloxytitanium; and titanium-containing catalysts such as titanium acetylacetonate, titanium diisopropoxide bisacetylacetonate, and titanium triethanolaminate.

However, the titanium-containing catalysts or inorganic tin-based catalysts are primarily used as the catalysts, while other catalysts may be used in mixture.

The catalyst is preferably added in an amount in the range of from 0.02 part by mass to 1.0 part by mass based on 100 parts by mass of the monomer components (excluding dodecenylsuccinic acid) at the time of polymerization. However, when the catalyst is used as a mixture, it is desirable that the content of the titanium-containing catalyst be 70% by mass or greater, and it is more desirable that the catalyst be entirely composed of a titanium-containing catalyst.

The melting temperature of the crystalline polyester resin is preferably in the range of from 50° C. to 120° C., and more preferably in the range of from 60° C. to 110° C. Furthermore, as will be described later, when a hydrocarbon-based wax is added to the magenta toner of the exemplary embodiment of the invention, it is desirable that the melting temperature of the crystalline polyester resin be lower than the melting temperature of the hydrocarbon-based wax.

The molecular weight of the crystalline polyester resin as determined by a molecular weight analysis according to a GPC method of the tetrahydrofuran (THF)-soluble fraction is such that the mass average molecular weight (Mw) is preferably in the range of from 5,000 to 100,000, and more preferably in the range of from 10,000 to 50,000, and the number average molecular weight (Mn) is preferably in the range of from 2,000 to 30,000, and more preferably in the range of from 5,000 to 15,000. The molecular weight distribution, Mw/Mn, is preferably in the range of from 1.5 to 20, and more preferably in the range of from 2 to 5. When the molecular weight is measured, it is desirable to dissolve the crystalline resin under heating in a water bath at 70° C. in order to increase the solubility of the crystalline resin in THF.

The crystalline polyester resin is such that the acid value is preferably in the range of from 4 mg KOH/g to 20 mg KOH/g, and more preferably in the range of from 6 mg KOH/g to 15 mg KOH/g. The hydroxyl group value is preferably in the range of from 3 mg KOH/g to 30 mg KOH/g, and more preferably in the range of from 5 mg KOH/g to 15 mg KOH/g.

(Release Agent)

The magenta toner according to the exemplary embodiment of the invention may contain a release agent. The release agent used may be a substance having a principal maximum endothermic peak in the DSC curve measured according to ASTM D3418-8 of from 60° C. to 120° C., and a melt viscosity at 140° C. of from 1 mPa·s to 50 mPa·s.

The release agent has an endothermic onset temperature in the DSC curve measured by a differential scanning calorimeter of preferably 40° C. or higher, and more preferably 50° C. or higher. The endothermic onset temperature varies depending on the low molecular weight wax among the molecular weight distribution constituting the wax, or on the type and amount of polar groups carried by the structure.

Generally, when the release agent is made to have a high molecular weight, the endothermic onset temperature increases along with the melting temperature, but in this system, the high molecular weight impairs the low melting temperature and low viscosity inherent to the wax (release agent). Therefore, it is effective to select and exclude only these low molecular weight waxes in the molecular weight distribution of the wax, and methods for the purpose include molecular weight distillation, solvent fractionation, gas chromatographic fractionation, and the like.

The DSC analysis is carried out as described above.

The melt viscosity of the release agent is measured with an E type viscometer. Upon the measurement, an E type viscometer (manufactured by Tokyo Keiki, Inc.) equipped with an oil circulating constant temperature bath is used. Measurements are conducted using a cone plate-cup combination plate with a cone angle of 1.34 degrees. A sample is placed in the cup, and the temperature of the circulating apparatus is set at 140° C. An empty measurement cup and a cone are set in the measurement apparatus, and the measurement apparatus is maintained at a constant temperature while oil is circulated. Once the temperature is stabilized, 1 g of the sample is placed in the measuring cup, and then the cone is left to stand for 10 minutes in a stationary state. After stabilization, the cone is rotated, and the measurement is conducted. The speed of rotation of the cone is set to 60 rpm. The measurement is conducted three times, and the average value is designated as the melt viscosity, $\eta$.

Specific examples of the release agent include hydrocarbon-based waxes such as polyethylene waxes, polypropylene waxes, polybutene waxes, and paraffin waxes; silicones showing a softening point by heating; fatty acid amides such as oleic acid amide, erucic acid amide, ricinolic acid amide, and stearic acid amide; plant waxes such as carnauba wax, rice wax, candellila wax, wood wax, and jojoba wax; animal waxes such as beeswax; ester waxes such as fatty acid esters and montanic acid esters; mineral and petroleum waxes such as montan wax, ozokerite, ceresin, microcrystalline wax, and Fischer-Tropsch wax; and modification products thereof.

According to the exemplary embodiment of the invention, it is desirable to use a hydrocarbon-based wax having a melting temperature of equal to or higher than 60° C. and lower than 100° C. Particularly, when a crystalline polyester resin having a low solubility parameter is used as the binder resin, if a hydrocarbon-based wax is used in combination, compatibility with the specific solid solution as a colorant is enhanced, and aggregation of the specific solid solution may be further suppressed. At this time, if the melting temperature of the hydrocarbon-based wax is higher than the melting temperature of the crystalline polyester resin, the crystalline polyester resin melts first during fixing and dissolves into the amorphous polyester resin, so that the solubility parameter decreases. However, since the hydrocarbon-based wax melts, domain formation of the hydrocarbon-based wax may be suppressed, and also, domain formation of the specific solid solution may also be suppressed. Therefore, color developability may be further enhanced.

The proportion of the crystalline polyester resin in the binder resin in an embodiment of using a hydrocarbon-based wax and a crystalline polyester resin in combination is preferably from 1% by mass to 10% by mass (or from about 1% by mass to about 10% by mass), and more preferably from 2% by mass to 8% by mass, of the binder resin. When the proportion is 1% by mass or greater, the amount of decrease of the solubility parameter when used together with an amorphous polyester resin is large, and domain formation of the release agent and the specific solid solution is suppressed, so that color developability is enhanced. Furthermore, when the proportion is 10% by mass or less, domain formation of the crystalline resin itself is suppressed, and color developability is enhanced.

The addition amount of the release agent is preferably from 1 part by mass to 15 parts by mass, and more preferably from 3 parts by mass to 10 parts by mass, based on 100 parts by mass of the binder resin. When the addition amount is 1 part by mass or more, the effect of adding the release agent is exhibited. Furthermore, when the addition amount is 15 parts by mass or less, the toner is prevented from undergoing extreme deterioration of fluidity, and also, the charge distribution is prevented from being very broad.

(Other Components)

The magenta toner of the exemplary embodiment of the invention may contain inorganic or organic particles as necessary.

Examples of the inorganic particles that may be added include silica, hydrophobization-treated silica, alumina, titanium oxide, calcium carbonate, magnesium carbonate, tricalcium phosphate, colloidal silica, alumina-treated colloidal silica, cation-surface treated colloidal silica, and anion-surface treated colloidal silica, and these may be used individually or in combination. Among them, it is desirable to use colloidal silica. The particle size is suitably from 5 nm to 100 nm. Furthermore, particles having different particle sizes may also be used in combination. The particles may be directly added to the process of toner production, but it is desirable to use a dispersion of the particles prepared in advance in a water-soluble medium such as water using an ultrasonic dispersing machine. In regard to dispersion, dispersibility may be enhanced by using an ionic surfactant, a polymer acid, a polymer base or the like.

In addition, the toner may also contain a known material such as a charge controlling agent. The number average particle size of the material added in that case is preferably 1 μm or less, and more suitably from 0.01 μm to 1 μm. Such a number average particle size may be measured by using, for example, a Microtrac analyzer or the like.

<Production of Toner Particles>

The method for preparing a magenta toner of the exemplary embodiment of the invention may be carried out using a kneading pulverization method or a wet granulation method that are generally used. Here, examples of the wet granulation method include a suspension polymerization method, an emulsion polymerization method, an emulsion polymerization aggregation method, a soap-free emulsion polymerization method, a non-aqueous dispersion polymerization method, an in-situ polymerization method, an interface polymerization method, an emulsion dispersion granulation method, and an aggregation and coalscence method. Among them, a wet granulation method is desirable from the viewpoint of enclosing a crystalline resin in the toner.

Suitable examples of the wet granulation method include known methods such as a melt suspension method, an emulsion aggregation method, and a solution suspension method. The emulsion aggregation method will be described below as an example.

The emulsion aggregation method is a preparation method including a step of forming aggregated particles in a dispersion liquid obtained by dispersing resin particles (hereinafter, may be referred to as "emulsion liquid") (aggregation step), and a step of heating the aggregated particle dispersion liquid, and coalescing the aggregated particles (coalescence step). Furthermore, the method may further include a step of dispersing the aggregated particles (dispersion step) before the aggregation step, or a step of adding and blending a particle dispersion liquid having particles dispersed therein, into the aggregated particle dispersion liquid, and thereby attaching the particles to the aggregated particles to form attached particles (attachment step) between the aggregation step and the coalescence step. In the attachment step, the particle dispersion liquid is added and blended into the aggregated particle dispersion liquid prepared in the aggregation step, and thereby the particles are attached to the aggregated particles to form attached particles. However, since the particles that are added correspond to particles that are newly added to the aggregated particles from the standpoint of the aggregated particles, the particles may be referred to as "additional particles."

The additional particles may be a single type of release agent particles, colorant particles and the like in addition to the resin particles, or may be plural kinds of particles in combination. The method for additionally blending the particle dispersion liquid is not particularly limited, and for example, the method may be carried out slowly and continuously, or may be carried out stepwise in several divided portions. When the attachment step is provided, a pseudo-shell structure may be formed.

It is desirable for the toner to form a core-shell structure by an operation of adding the additional particles. The binder resin which constitutes the principal component of the additional particles is a resin for a shell layer. When this method is used, control of the toner shape may be conveniently achieved by regulating the temperature, the stirring speed, the pH and the like in the coalescence step.

In regard to the emulsion aggregation method, a crystalline polyester resin dispersion liquid is used, and it is desirable to use an amorphous polyester resin dispersion liquid. Furthermore, it is more desirable to include an emulsification step of emulsifying the crystalline polyester resin dispersion liquid and the amorphous polyester resin and forming emulsion particles (liquid droplets).

In the emulsification step, the emulsion particles (liquid droplets) of the amorphous polyester resin are desirably formed by applying shear force to a solution obtained by mixing an aqueous medium and a mixture liquid containing the amorphous polyester resin and optionally a colorant (polymer liquid). At this time, the viscosity of the polymer liquid may be decreased by heating the polymer liquid to a temperature equal to or higher than the glass transition temperature of the amorphous polyester resin, and thus emulsion particles may be formed. Also, a dispersant may be used.

Hereinafter, such a dispersion liquid of emulsion particles may be referred to as an "amorphous polyester resin dispersion liquid."

Examples of the emulsifying machine used to form the emulsion particles include a homogenizer, a homomixer, a pressurized kneader, an extruder, and a medium dispersing machine. The size of the emulsion particles (liquid droplets) of the polyester resin is, as an average particle size (volume average particle size), preferably from 0.010 μm to 0.5 μm, and more preferably from 0.05 μm to 0.3 μm. The volume average particle size of the resin particles is measured using a Doppler scattering particle size distribution analyzer (Microtrac UPA9340, manufactured by Nikkiso Co., Ltd.).

If the melt viscosity of the resin is high at the time of emulsification, the particles are not made as small as a desired particle size. Therefore, an amorphous polyester resin dispersion liquid having a desired resin particle may be obtained by increasing the temperature using an emulsifying apparatus capable of pressurization to a pressure equal to or higher than the atmospheric pressure, and performing emulsification while the resin viscosity is lowered.

In the emulsification step, a solvent may be added to the resin in advance for the purpose of decreasing the viscosity of the resin. There are no particular limitations on the solvent used as long as the solvent is capable of dissolving the polyester resin, and ether-based solvents such as tetrahydrofuran (THF); ester-based and ketone-based solvents such as methyl acetate, ethyl acetate, and methyl ethyl ketone; and benzene-based solvents such as benzene, toluene, and xylene may be used. It is desirable to use ester-based and ketone-based solvents such as ethyl acetate and methyl ethyl ketone.

Furthermore, an alcohol-based solvent such as ethanol or isopropyl alcohol may be directly added to water or the resin. A salt such as sodium chloride or potassium chloride, or ammonia may also be added. Among these, it is desirable to use ammonia.

A dispersant may also be added. Examples of the dispersant include water-soluble polymers such as polyvinyl alcohol, methyl cellulose, carboxymethyl cellulose, and polyacrylic acid sodium; anionic surfactants such as sodium dodecylbenzene sulfonate, sodium octadecyl sulfate, sodium oleate, sodium laurate, and potassium stearate; cationic surfactants such as laurylamine acetate, and lauryltrimethylammonium chloride; amphoteric surfactants such as lauryldimethylamine oxide; nonionic surfactants such as polyoxyethylene alkyl ether, polyoxyethylene alkyl phenyl ether, and polyoxyethylene alkylamine; and inorganic compounds such as tricalcium phosphate, aluminum hydroxide, calcium sulfate, calcium carbonate, and barium carbonate. Among these, anionic surfactants are suitably used.

The amount of the dispersant used is desirably from 0.01 part by mass to 20 parts by mass based on 100 parts by mass of the binder resin. However, since the dispersant often affects chargeability, when emulsifiability may be secured by means of the hydrophilicity of the polyester resin main chain, the acid value of the terminal group, the magnitude of the hydroxyl group value, and the like, it is desirable not to add the dispersant if possible.

During the emulsification step, a dicarboxylic acid having a sulfonic acid group may be copolymerized into the amorphous polyester resin (that is, a constituent unit derived from a dicarboxylic acid having a sulfonic acid group is included in an appropriate amount among the acid-derived constituent units). The addition amount is desirably 10 mol % or less based on the acid-derived constituent units, but when emulsifiability may be secured by means of the hydrophilicity of the polyester resin main chain, the acid value of the terminal group, the magnitude of the hydroxyl group value, and the like, it is desirable not to add the dispersant if possible.

Furthermore, a reverse phase emulsification method may be used for the formation of the emulsion particles. The reverse emulsification method is a method of dissolving an amorphous polyester resin in a solvent, adding a neutralizing agent or a dispersion stabilizer to the solution as necessary, adding an aqueous medium dropwise to the mixture under stirring to obtain emulsion particles, and then removing the solvent in the resin dispersion liquid to obtain an emulsion liquid. At this time, the order of adding of the neutralizing agent or the dispersion stabilizer may be changed.

Examples of the solvent for dissolving the resin include formic acid esters, acetic acid esters, butyric acid esters, ketones, ethers, benzenes, and halogenated hydrocarbons. Specific examples include esters of methyl, ethyl, n-propyl, isopropyl, n-butyl, isobutyl, sec-butyl, t-butyl and the like of formic acid, acetic acid, butyric acid and the like; methyl ketones such as acetone, methyl ethyl ketone (MEK), methyl propyl ketone (MPK), methyl isopropyl ketone (MIPK), methyl butyl ketone (MBK), and methyl isobutyl ketone (MIBK); ethers such as diethyl ether, and diisopropyl ether; heterocyclic substituents such as toluene, xylene and benzene; and halogenated hydrocarbons such as carbon tetrachloride, methylene chloride, 1,2-dichloroethane, 1,1,2-trichloroethane, trichloroethylene, chloroform, monochlorobenzene, and dichloroethylidene. These solvents may be used individually, or two or more kinds may be used in combination. Among them, acetic acid esters, methyl ketones, and ethers, which are low-boiling point solvents, are usually desirably used, and particularly, acetone, methyl ethyl ketone, acetic acid, ethyl acetate, and butyl acetate are desirable. Among these solvents, it is desirable to use solvents having relatively high volatility so that the solvent does not remain behind in the resin particles. The amount of these solvents used is desirably from 20% by mass to 200% by mass, and more desirably from 30% by mass to 100% by mass, based on the amount of the resin.

As the aqueous medium, basically ion-exchanged water is used, but a water-soluble solvent may also be included to the extent that the oil droplets are not destroyed. Examples of the water-soluble solvent include single carbon chain alcohols such as methanol, ethanol, 1-propanol, 2-propanol, 1-butanol, 2-butanol, t-butanol, and 1-pentanol; ethylene glycol monoalkyl ethers such as ethylene glycol monomethyl ether, ethylene glycol monoethyl ether, and ethylene glycol monobutyl ether; and ethers, diols, THF, and acetone. Among these, ethanol and 2-propanol are desirably used.

The amount of these water-soluble solvents used is preferably from 0% by mass to 100% by mass, and more preferably from 5% by mass to 60% by mass, based on the amount of the resin. Furthermore, the water-soluble solvent may be used as a mixture with the ion-exchanged water to be added, and may also be added to the resin solution.

Furthermore, a dispersant may be added to the amorphous polyester resin solution and the aqueous components, if necessary. Examples of the dispersant include, particularly, cellulose derivatives such as hydroxymethyl cellulose, hydroxyethyl cellulose, and hydroxypropyl cellulose; synthetic polymers such as polyvinyl alcohol, polyvinyl pyrrolidone, polyacrylamide, polyacrylates, and polymethacrylates; and dispersion stabilizers such as gelatin, gum arabic, and agar, which form a hydrophilic colloid in aqueous components.

Furthermore, solid fine powders of silica, titanium oxide, alumina, tricalcium phosphate, calcium carbonate, calcium sulfate, barium carbonate, and the like may also be used.

Usually, these dispersion stabilizers are desirably added such that the concentration of the dispersion stabilizer in the aqueous components is from 0% by mass to 20% by mass, and more desirably from 0% by mass to 10% by mass.

Surfactants may also be used as the dispersant. Examples of the surfactants that may be used include those equivalent to the surfactants used in the colorant dispersion liquid that will be described below. For example, natural surface active components such as saponin, as well as cationic surfactants such as alkylamine hydrochloride acetates, quaternary ammonium salts, and glycerins; and anionic surfactants such as fatty acid soaps, sulfuric acid esters, alkylnaphthalenesulfonates, sulfonates, phosphoric acid, phosphoric acid esters, and sulfosuccinates. Anionic surfactants and nonionic surfactants are desirably used.

In order to adjust the pH of the emulsion liquid, a neutralizing agent may also be added. As the neutralizing agent, general acids and alkalis such as nitric acid, hydrochloric acid, sodium hydroxide and ammonia may be used.

As the method of removing a solvent from the emulsion liquid, a method of volatilizing the solvent from the emulsion liquid at a temperature of from 15° C. to 70° C., and a method of combining pressure reduction to the aforementioned method are desirably used.

According to the exemplary embodiment of the invention, from the viewpoint of the particle size distribution or particle size controllability, it is desirable to use a method of emulsifying by a reverse phase emulsification method, and then removing the solvent by heating under reduced pressure. Furthermore, in the case of using the emulsion liquid in toner, dispersants or surfactants are not used as far as possible, from the viewpoint of the influence on chargeability, and it is desirable to control emulsifiability by means of the hydrophilicity of the polyester resin main chain, the acid value of the terminal group, the magnitude of the hydroxyl group value, and the like.

Emulsification of the crystalline polyester may also be carried out by the same operation as in the case of the amorphous polyester resin. In this emulsification step, the emulsion particles (liquid droplets) of the crystalline polyester resin are desirably formed by applying shear force to a solution obtained by mixing an aqueous medium and a mixture liquid containing the crystalline polyester resin and optionally a colorant (polymer liquid). At this time, the polymer liquid may be melted by first heating the polymer liquid to a temperature equal to or higher than the melting temperature of the crystalline polyester resin, subsequently emulsification may be performed at a temperature higher by 10° C. to 20° C. than the recrystallization temperature, to thereby decrease the viscosity of the polymer liquid, and thus emulsion particles may be formed. A dispersant may also be used. Hereinafter, such a dispersion liquid of emulsion particles may be referred to as a "crystalline polyester resin dispersion liquid."

As the method for dispersing the colorant or the release agent, for example, a general method for dispersing with a high pressure homogenizer, a rotary shear type homogenizer, an ultrasonic dispersing machine, a high pressure impact type dispersing machine, or a ball mill, a sand mill or a dyno mill, which use media, may be used without any particular limitations.

If necessary, an aqueous dispersion liquid of a colorant may be prepared using a surfactant, or an organic solvent dispersion liquid of a colorant may be prepared using a dispersant. Hereinafter, such a dispersion liquid of a colorant or a release agent may be referred to as a "colorant dispersion liquid" or a "release agent dispersion liquid."

The dispersants used in the colorant dispersion liquid or the release agent dispersion liquid are generally surfactants. Suitable examples of the surfactants include anionic surfactants such as sulfuric acid ester salts, sulfonic acid salts, phosphoric acid esters, and soaps; cationic surfactants such as amine salts, and quaternary ammonium salts; and nonionic surfactant such as polyethylene glycols, alkylphenol ethylene oxide adducts, and polyols. Among these, ionic surfactants are desirable, and anionic surfactants and cationic surfactants are more desirable. The nonionic surfactants may be used in combination with the anionic surfactants or cationic surfactants. Furthermore, it is desirable that the surfactants have the same polarity as the dispersants used in other dispersion liquids such as the release agent dispersion liquid.

Specific examples of the anionic surfactants include fatty acid soaps such as potassium laurate, and sodium oleate; sulfuric acid esters such as octyl sulfate, and lauryl sulfate; sulfonic acid salts such as sodium alkylnaphthalenesulfonates such as lauryl sulfonate, dodecyl sulfonate and dodecylbenzene sulfonate, naphthalene sulfonate-formalin condensate, monooctyl sulfosuccinate, and dioctyl sulfosuccinate; phosphoric acid esters such as lauryl phosphate, and isopropyl phosphate; sulfosuccinic acid salts such as sodium dialkylsulfosuccinates such as sodium dioctylsulfosuccinate, disodium lauryl sulfosuccinate, and disodium lauryl polyoxyethylene sulfosuccinate. Among these, alkylbenzene sulfonate compounds such as dodecylbenzene sulfonate and branched derivatives thereof are desirable.

Specific examples of the cationic surfactants include amine salts such as laurylamine hydrochloride, and stearylamine hydrochloride; and quaternary ammonium salts such as lauryltrimethylammonium chloride, and dilauryldimethylammonium chloride.

Specific examples of the nonionic surfactants include alkyl ethers such as polyoxyethylene octyl ether, and polyoxyethylene lauryl ether; alkyl phenyl ethers such as polyoxyethylene octyl phenyl ether, and polyoxyethylene nonyl phenyl ether; alkyl esters such as polyoxyethylene laurate, polyoxyethylene stearate, and polyoxyethylene oleate; alkylamines such as polyoxyethylene lauryl aminoether, polyoxyethylene stearyl aminoether, and polyoxyethylene oleyl aminoether; alkylamides such as polyoxyethylene lauric acid amide, and polyoxyethylene stearic acid amide; plant oil ethers such as polyoxyethylene castor oil ether, and polyoxyethylene rapeseed oil ether; alkanaolamides such as lauric acid diethanolamide, stearic acid diethanolamide, and oleic acid diethanolamide; and sorbitan ester ethers such as polyoxyethylene sorbitan monolaurate, and polyoxyethylene sorbitan monopalmitate.

The addition amount of the dispersant that is used is desirably from 2% by mass to 30% by mass, and more desirably from 5% by mass to 10% by mass, based on the colorant or the release agent.

The aqueous dispersion medium to be used is desirably a dispersion medium with a lower amount of impurities of metal ions and the like, such as distilled water or ion-exchanged water, and an alcohol or the like may also be added. Polyvinyl alcohol or a cellulose-based polymer may also be added to the dispersion medium, but it is desirable not to use such a polymer if possible, so that the component does not remain in the toner.

There are no particular limitations on the apparatus for preparing dispersion liquids of various additives, but for example, dispersing apparatuses that are known per se, such as a rotary shear type homogenizer; a ball mill, a sand mill or a dyno mill which use media; and apparatuses equivalent to those used in the preparation of the colorant dispersion liquid or the release agent dispersion liquid, may be selected and used.

During the aggregation step, it is desirable to use an aggregating agent to form aggregated particles. Examples of the aggregating agent include surfactants having reverse polarity to that of the surfactants used as the dispersants, and general inorganic metal compounds (inorganic metal salts) or polymers thereof. The metal elements constituting the inorganic metal salts are elements having divalent or higher-valent charges, which belong to the Groups 2A, 3A, 4A, 5A, 6A, 7A, 8, 1B, 2B and 3B in the Periodic Table of Elements (long periodic table), and elements that dissolve in the form of ions in the aggregated system of the resin particles are desirable.

Specific examples of the inorganic metal salt that may be used include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide. Among them, aluminum salts and polymers thereof in particular are suitable. In general, in order to obtain a sharper particle size distribution, divalent inorganic metal salts are more suitable than monovalent inorganic metal salts, and trivalent or higher-valent inorganic metal salts are more suitable than divalent inorganic metal salts, while inorganic metal salt polymers are more suitable when compared with inorganic metal salts of the same valence values.

The addition amount of these aggregating agents may vary with the type or valency of the aggregating agent, but generally, the addition amount is desirably in the range of from 0.05% by mass to 0.1% by mass. The aggregating agent does not all remain in the toner, but is removed during the step of toner production through discharge to the aqueous medium, formation of coarse powder, and the like. Particularly, during the process for toner production, if the amount of the solvent in the resin is large, the solvent and the aggregating agent interact, and the aggregating agent is easily discharged into the aqueous medium. Therefore, it is desirable to regulate the aggregating agent in accordance with the residual amount of the solvent.

In the coalescence step, it is desirable to carry out coalescence of the aggregated particles by stopping the progress of aggregation by adjusting the pH of the suspension of the aggregate to the range of from 5 to 10 under stirring which is equivalent to that used in the aggregation step, and heating the system to a temperature equal to or higher than the glass transition temperature (Tg) of the resin or a temperature equal to or higher than the melting temperature of the crystalline resin (hereinafter, the glass transition temperature and the melting temperature will be collectively described as "Tg and the like"). Furthermore, the heating may be carried out for a time period capable of achieving desired coalescence, and heating may be carried out for from 0.2 hour to 10 hours. Thereafter, when the temperature of the particles is decreased to a temperature equal to or lower than the Tg and the like of the resin, and the particles are solidified, the particle shape and the surface properties change with the rate of temperature decrease. The temperature is decreased to a temperature equal to or lower than the Tg and the like of the resin at a rate of 0.5° C./min or higher, and more desirably at a rate of 1.0° C./min or higher.

Furthermore, when particles are grown to a desired particle size by adjusting the pH or adding an aggregating agent in accordance with the aggregation step while heating the system to a temperature equal to or higher than the Tg and the like of the resin, the temperature of the system is decreased to a temperature equal to or lower than the Tg and the like of the resin at a rate of 0.5° C./min in accordance with the case of the coalescence step, and the particle growth is terminated simultaneously with solidification, the aggregation step and the coalescence step may be carried out simultaneously. Therefore, this is desirable from the viewpoint of simplification of the process. However, it may become difficult to produce the core-shell structure as described above.

After the coalescence step is completed, the particles are washed and dried, and thus toner particles are obtained. It is desirable to subject the particles to displacement washing using ion-exchanged water, and the extent of washing is generally determined by monitoring the electrical conductivity of the filtrate. Finally, it is desirable to adjust the electrical conductivity to 25 μS/cm or less. During the washing, a step of neutralizing the ions with an acid or an alkali may be included, and it is desirable to adjust the pH value of the treatment by an acid to 6.0 or lower, and to adjust the pH value of the treatment by an alkali to 8.0 or higher.

The solid-liquid separation after washing is not particularly limited, but from the viewpoint of productivity, pressurized filtration such as suction filtration, and filter press are desirably used. Furthermore, the method of drying is not particularly limited, but from the viewpoint of productivity, freeze-drying, flash jet drying, fluidized drying, vibration type fluidized drying, and the like are desirably used. The drying is carried out such that the final moisture content of the toner is 1% by mass or less, and more preferably 0.7% by mass or less.

The toner particles thus obtained may be treated by mixing externally added additives such as inorganic particles and/or organic particles as a fluidity aid, a cleaning aid, an abrasive or the like.

Examples of the inorganic particles that may be externally added include all particles that are conventionally used as externally added additives for the toner surface, such as particles of silica, alumina, titanium oxide, calcium carbonate, magnesium carbonate, tricalcium phosphate, and cerium oxide. These inorganic particles desirably have the surfaces hydrophobically treated.

Examples of the organic particles that may be externally added include all particles that are conventionally used as externally added additives for the toner surface, such as particles of a styrene-based polymer, vinyl-based resins such as a (meth)acrylic polymer and an ethylene-based polymer, a polyester resin, a silicone resin, and a fluorine-based resin.

These externally added additives desirably have a primary particle size of from 0.01 μm to 0.5 μm. Furthermore, a lubricating agent may be added. Examples of the lubricating agent include fatty acid amides such as ethylene bis-stearic acid amide and oleic acid amide; fatty acid metal salts such as zinc stearate and calcium stearate; and higher alcohols such as Unilin alcohols. The primary particle size of these particles is desirably from 0.5 μm to 8.0 μm.

Furthermore, it is desirable to use inorganic particles of two or more kinds, and it is desirable that one kind of the inorganic particles have an average primary particle size of from 30 nm to 200 nm, and more desirably an average primary particle size of from 30 nm to 180 nm.

Specifically, silica, alumina and titanium oxide particles are desirable, and it is particularly desirable to add hydrophobized silica. Particularly, it is desirable to use silica and titanium oxide in combination, or to use silica particles having different particle sizes in combination. Furthermore, it is also desirable to use organic particles having a particle size of from 80 nm to 500 nm in combination. Examples of a hydrophobizing agent for a hydrophobization treatment of the externally added additive include known materials, and specific examples include coupling agents such as silane-based coupling agents, titanate-based coupling agents, aluminate-based coupling agents, and zirconium-based coupling agents, and silicone oil. Furthermore, an example of the hydrophobization treatment of the externally added additives may be a polymer coating treatment.

The externally added additives are desirably attached or fixed to the toner surface by applying mechanical impact force with a V-type blender, a sample mill, a Henschel mixer or the like.

<Properties of Magenta Toner>

The magenta toner of the exemplary embodiment of the invention preferably has a volume average particle size (the so-called particle size of the toner particles; the same applies throughout this section) in the range of from 3 μm to 9 μm, more preferably in the range of from 3.5 μm to 8.5 μm, and even more preferably in the range of from 4 μm to 8 μm. When the volume average particle size is 9 μm or less, high precision images may be easily reproduced. Furthermore, when the volume average particle size is 3 μm or greater, the occurrence of toner with reverse polarity is suppressed, and thus the influence on the image quality such as paper contamination or white spot are reduced.

Furthermore, for the magenta toner of the exemplary embodiment of the invention, cumulative distributions of the volume and the number are plotted from the small diameter side with respect to the particle size ranges divided (channels) on the basis of the particle size distribution measured by a method described below. When the particle size of cumulative 16% by volume is designated as volume $D_{16v}$, the particle size of cumulative 50% is designated as volume $D_{50v}$, and the particle size of cumulative 84% is designated as volume $D_{84v}$, the volume average particle size distribution index (GSDv) calculated from the expression $(D_{84v}/D_{16v})^{0.5}$ is preferably from 1.15 to 1.30, and more preferably from 1.15 to 1.25.

The measurement of the volume average particle size or the like may be carried out using a MULTISIZER II (manufactured by Beckman Coulter, Inc.) with an aperture diameter of 100 μm. At this time, the measurement is carried out by dispersing a toner in an aqueous electrolyte solution (aqueous solution of ISOTON) (concentration: 1% by mass), adding a surfactant (trade name: CONTAMINON), and then dispersing the liquid using an ultrasonic dispersing machine for 300 seconds or longer.

In regard to the particle size distribution, a cumulative distribution of each of the volume and the number is plotted from the smaller diameter side with respect to the particle size range divided on the basis of the particle size distribution measured using a MULTISIZER II (number of divisions: a range of from 1.59 μm to 64.0 μm is divided into 16 channels at an interval of 0.1 on the log scale; specifically, the range is divided into channel 1 of equal to or greater than 1.59 μm to less than 2.00 μm; channel 2 of equal to or greater than 2.00 μm to less than 2.52 μm; channel 3 of equal to or greater than 2.52 μm to less than 3.175 μm; and the like, such that the log value of the lower limit on the left side becomes (log 1.59=) 0.2, (log 2.0=) 0.3, (log 2.52=) 0.4, . . . , and 1.7), the particle size at cumulative 16% is designated as volume $D_{16v}$ and number $D_{16p}$, the particle size at cumulative 50% is designated as volume $D_{50v}$ (volume average particle size) and number $D_{50p}$, and the particle size at cumulative 84% is designated as volume $D_{84v}$ and number $D_{84p}$.

The toner desirably has a spherical shape with a shape factor SF1 in the range of from 110 to 145. When the shape is spherical in this range, the transfer efficiency and the denseness of images are enhanced, and high quality images may be formed.

The shape factor SF1 is more desirably in the range of from 110 to 140.

Here, the shape factor SF1 is determined by the following equation (I).

$$SF1=(ML^2/A)\times(\pi/4)\times 100 \quad (I)$$

In the equation (I), ML represents the absolute maximum length of a toner particle; and A represents the projection area of a toner particle.

The shape factor SF1 may be quantified by analyzing a microscopic image or a scanning electron microscopic (SEM) image using an image analyzer, and may be calculated, for example, in the following manner. That is, an optical micrographic image of toner particles spread on a slide glass surface is placed in a Luzex image analyzer through a video camera, and the maximum length and the projected area are determined and calculated by the above equation (I) for 100 or more toner particles. After the calculation, average values are determined, and the shape factor is obtained.

When the shape factor SF1 of the toner is in the range described above, excellent chargeability, cleaning properties, and transferability are obtained for a long period of time.

In recent years, the shape factor has often been measured using a FPIA-3000 manufactured by Sysmex Corp. because the measurement may be carried out conveniently. The FPIA-3000 optically analyzes about 4,000 particle images, and a projected image for one particle is analyzed. Specifically, first, the perimeter of one particle is calculated from the projected image (perimeter of the particle image). Subsequently, the area of the projected image is calculated, a circle having the same area as that area is assumed, and the circumference of the circle is calculated (perimeter of the circle determined from the circle equivalent diameter). The degree of circularity is calculated from the formula: degree of circularity=perimeter of the circle determined from the circle equivalent diameter/perimeter of the particle image. As the value is closer to 1.0, the shape is close to a spherical shape. This degree of circularity is preferably from 0.945 to 0.990, and more preferably from 0.950 to 0.975. When the degree of circularity is 0.950 or higher, satisfactory transfer efficiency may be obtained. Furthermore, when the degree of circularity is 0.975 or less, satisfactory cleaning properties may be obtained.

Although instrumental errors exist, a shape factor SF1 of 110 approximately corresponds to a degree of circularity of 0.990 in the FPIA-3000. In addition, shape factor SF1 of 140 approximately corresponds to a degree of circularity of 0.945 in the FPIA-3000.

<Toner Set>

The magenta toner of the exemplary embodiment of the invention as described above may be used together with toners of other colors as a toner set.

An example of the toner set of the exemplary embodiment may be a toner set including the magenta toner of the present exemplary embodiment, and a yellow toner containing any one of C.I. Pigment Yellow 74, C.I. Pigment Yellow 180, or C.I. Pigment Yellow 185 as a colorant. When this toner set is used, the reproducible color gamut of the red region is extended.

Another example may be a toner set including the magenta toner of the present exemplary embodiment, and a cyan toner containing C.I. Pigment Blue 15 as a colorant. When this toner set is used, the reproducible color gamut of the blue region is extended.

Still another example may be a toner set including the magenta toner of the present exemplary embodiment, a yellow toner containing any one of C.I. Pigment Yellow 74, C.I. Pigment Yellow 180 or C.I. Pigment Yellow 185 as a colorant, and a cyan toner containing C.I. Pigment Blue 15 as a colorant. When this toner set is used, the reproducible color gamut in the red region and the blue region is extended.

There are no particular limitations on the yellow toner as long as it contains any one of C.I. Pigment Yellow 74, C.I. Pigment Yellow 180, and Pigment Yellow 185, but from the viewpoint of chargeability or fixability, it is desirable to have the same material constitution as the magenta toner of the exemplary embodiment of the invention. It is desirable that 80% by mass or more of the colorant of the toner be composed of any one of C.I. Pigment Yellow 74, C.I. Pigment Yellow 180, or C.I. Pigment Yellow 185, and more desirably 100% by mass be composed of any one of the yellow pigments. Examples of other colorants that may be incorporated include yellow lead, zinc yellow, yellow iron oxide, cadmium yellow, chrome yellow, Hansa yellow, Hansa yellow 10G, benzidine yellow G, benzidine yellow GR, threne yellow, quinoline yellow, and permanent yellow NCG. Specific examples include C.I. Pigment Yellow 93, C.I. Pigment Yellow 155, C.I. Pigment Yellow 128, C.I. Pigment Yellow 111, and C.I. Pigment 17.

The cyan toner is not particularly limited as long as it contains C.I. Pigment Blue 15 as a colorant, but from the viewpoint of chargeability or fixability, it is desirable that the cyan toner have the same material constitution as that of the magenta toner of the exemplary embodiment of the invention. Particularly, C.I. Pigment Blue 15:3 is desirable. It is desirable that 80% by mass or more of the colorant of the toner be composed of C.I. Pigment Blue 15:3, and more desirably 100% by mass be composed of that pigment.

When a color set of such a combination is used, the image quality may approach photographic image quality.

<Magenta Developer>

The magenta toner of the exemplary embodiment of the invention is used directly as a single-component developer, or is mixed with a carrier and used as a two-component developer.

There are no particular limitations on the carrier that may be used, but the carrier is desirably a carrier coated with a resin (generally, referred to as a "coated carrier", a "resin-coated carrier" or the like), and more desirably a carrier coated with a nitrogen-containing resin. Examples of the nitrogen-containing resin appropriate for coating include acrylic resins containing dimethylaminoethyl methacrylate, dimethylacrylamide, acrylonitrile, and the like; amino resin containing urea, urethane, melamine, guanamine, aniline and the like; amide resins, and urethane resins, and copolymer resins thereof may also be used. Among these, particularly a urea resin, a urethane resin, a melamine resin, and an amide resin are desirable.

For the coating resin for the carrier, two or more kinds of the nitrogen-containing resins may be used in combination, or the nitrogen-containing resin and a resin which does not contain nitrogen may be used in combination. Furthermore, the nitrogen-containing resin may be granulated, and the granules may be dispersed in a resin which does not contain nitrogen.

Generally, the carrier is functionally required to have an appropriate electrical resistance value, and specifically, it is desirable that the carrier have an electrical resistance value of from $10^9\Omega\cdot$cm to $10^{14}\Omega\cdot$cm. For example, when the electrical resistance value is as low as $10^6\Omega\cdot$cm such as in the case of a powdered iron carrier, it is desirable to coat the carrier with an insulating (having a volume resistivity of $10^{14}\Omega\cdot$cm or greater) resin and to disperse a conductive powder within the resin coating layer.

Specific examples of the conductive powder include powders of metals such as gold, silver, and copper; carbon black; semiconductive oxides such as titanium oxide and zinc oxide; and powders of titanium oxide, zinc oxide, barium sulfate, aluminum borate or potassium titanate covered with tin oxide, carbon black or a metal on the surface. Among these, carbon black is desirable.

Examples of the method of forming the resin coating layer on the surface of a carrier core material include a dipping method of dipping a powder of the carrier core material in a solution for coating layer formation; a spray method of spraying a solution for coating layer formation on the surface of a carrier core material; a fluidized bed method of spraying a solution for coating layer formation while a carrier core material is floated by an air flow; a kneader coater method of mixing a carrier core material and a solution for coating layer formation in a kneader coater and removing the solvent; and a powder coating method of granulating a coating resin, mixing the coating resin with a carrier core material in a kneader coater at a temperature equal to or higher than the melting temperature of the coating resin, and cooling the system to coat the carrier material. Among these, a kneader coater method and a powder coating method are particularly desirable.

For the production of the carrier, a heating kneader, a heating Henschel mixer, a UM mixer or the like may be used, and depending on the amount of the coating resin, a heating fluidized rolling bed, a heating kiln or the like may also be used.

The average thickness of the resin coating layer formed by the methods described above is usually in the range of from 0.1 μm to 10 μm, and more suitably in the range of from 0.2 μm to 5 μm.

The core material used in the carrier (carrier core material) is not particularly limited, and examples include magnetic metals such as iron, steel, nickel and cobalt; magnetic oxides such as ferrite and magnetite; and glass beads. Particularly in the case of using a magnetic brush method, a magnetic metal is desirable. The number average particle size of the carrier core material is generally desirably from 10 μm to 100 μm, and more desirably from 20 μm to 80 μm.

The mixing ratio of the magenta toner of the present exemplary embodiment and the carrier in the two-component developer is not particularly limited, and may be selected according to the purpose. However, the mixing ratio of toner: carrier is desirably in the range of about 1:100 to 30:100, and more desirably in the range of about 3:100 to 20:100, on a mass basis.

[Image Forming Apparatus, Toner Accommodating Container (Toner Cartridge), and Process Cartridge]

First, the image forming apparatus of the exemplary embodiment of the invention using the magenta toner of the exemplary embodiment will be described, and then a toner accommodating container of the exemplary embodiment that is mounted on the image forming apparatus will be discussed, while the process cartridge of the exemplary embodiment will be described separately. The image forming apparatus, toner accommodating container and process cartridge described below are only illustrative examples, and the exemplary embodiment of the invention is not intended to be limited to these examples.

<Image Forming Apparatus>

The image forming apparatus of the exemplary embodiment of the invention includes an electrostatic latent image holding member that is capable of holding an electrostatic latent image formed on the surface; a charging unit that charges the surface of the electrostatic latent image holding member; an electrostatic latent image forming unit that forms an electrostatic latent image on the surface of the charged electrostatic latent image holding member; a toner image forming unit that accommodates the magenta developer of the exemplary embodiment, and also develops the electrostatic latent image formed on the surface of the electrostatic latent image holding member with a toner and thereby forms a toner image on the surface of the electrostatic latent image holding member; a transfer unit that transfers the toner image on a recording medium; and a fixing unit that fixes the transfer image transferred on the recording medium.

According to the exemplary embodiment, a unit of intermediate transfer system that performs the transfer through an intermediate transfer member is illustrated as an example of the transfer unit. This intermediate transfer unit includes a primary transfer unit that primary transfers the developed toner image to an intermediate transfer member, and a secondary transfer unit that secondary transfers the toner image transferred to the intermediate transfer member, to a recording medium. Furthermore, the image forming apparatus according to the exemplary embodiment includes a cleaning unit that removes the toner remaining on the surface of the electrostatic latent image holding member after the transfer by the primary transfer unit.

A schematic configuration diagram showing an example of the image forming apparatus of the exemplary embodiment is shown in FIG. 1. The image forming apparatus 200 has a configuration including an electrostatic latent image holding member 201; a charging device 202 which is a charging unit; an image writing apparatus 203 which is an electrostatic latent image forming unit; a rotary developing apparatus 204 which is a toner image forming unit; a primary transfer roller 205 which is a primary transfer unit (transfer unit); a cleaning apparatus 206 which is a cleaning unit based on a cleaning blade; an intermediate transfer member 207 which is an intermediate transfer member that laminates toner images of plural colors on a recording paper (recording medium) P and transfers the laminated toner images altogether; three supporting rollers 208, 209 and 210 which support under tension the intermediate transfer member 207 together with the primary transfer roller 205; a secondary transfer roller 211 which is a secondary transfer unit (transfer unit); a conveyor belt 212 that conveys the recording paper P after a secondary transfer; and a fixing apparatus (fixing unit) 215 that interposes the recording paper P conveyed by the conveyor belt 212 between two rollers such as a heating roller 213 and a pressing roller 214, and fixes the toner image with heat and pressure.

The electrostatic latent image holding member 201 is formed in a drum shape as a whole, and has a photosensitive layer on the outer peripheral surface (drum surface). This electrostatic latent image holding member 201 is installed in a rotatable manner in the direction of the arrow C in FIG. 1. The charging device 202 charges the surface of the electrostatic latent image holding member 201. The image writing apparatus 203 forms an electrostatic latent image by irradiating imagewise with light X the electrostatic latent image holding member 201 that has been charged by the charging device 202, and thus forms an electrostatic latent image.

The rotary developing apparatus 204 has four developing devices 204Y, 204M, 204C and 204K accommodating toners for yellow, magenta, cyan and black colors, respectively. In this apparatus, since a toner is used in the developer for image formation, the developing device 204Y accommodates a yellow toner, the developing device 204M accommodates a magenta toner, the developing device 204C accommodates a cyan toner, and the developing device 204K accommodates a black toner. According to the present exemplary embodiment, the magenta toner of the exemplary embodiment of the invention is used as the magenta toner accommodated in the developing device 204M.

This rotary developing apparatus 204 is driven to rotate such that the four developing devices 204Y, 204M, 204C and 204K sequentially come close to the electrostatic latent image holding member 201 and face the electrostatic latent image holding member 201. Thereby, the respective toners are transferred to the electrostatic latent image corresponding to the respective colors, and a toner image is formed.

The primary transfer roller 205 interposes the intermediate transfer member 207 between the primary transfer roller and the electrostatic latent image holding member 201, while transferring (primary transfer) the toner image formed on the surface of the electrostatic latent image holding member 201 onto the outer peripheral surface of the intermediate transfer member 207 which is in an endless belt shape. The cleaning apparatus 206 cleans (removes) the toner and the like remaining on the surface of the electrostatic latent image holding member 201 after transfer. The intermediate transfer member 207 is installed such that tension is applied to the inner peripheral surface of the intermediate transfer member 207 by the plural supporting rollers 208, 209 and 210 and the primary transfer roller 205, and the intermediate transfer member 207 is supported to be rotatable in the direction reverse to the direction of the arrow D. The secondary transfer roller 211 interposes the recording paper (recording medium) P that is conveyed by a paper conveying unit (not depicted) in the direction of the arrow E, between the secondary transfer roller and the supporting roller 210, while transferring (secondary transfer) the toner image transferred to the outer peripheral surface of the intermediate transfer member 207, to the recording paper P.

The image forming apparatus 200 sequentially forms toner images on the surface of the electrostatic latent image holding member 201 and repeatedly transfers the toner images to the outer peripheral surface of the intermediate transfer member 207. The image forming apparatus 200 operates as follows. That is, first, the electrostatic latent image holding member 201 is driven to rotate, and the surface of the electrostatic latent image holding member 201 is charged (charging step) by the charging device 202. Subsequently, the electrostatic latent image holding member 201 is irradiated with image light by the image writing apparatus 203, and thus an electrostatic latent image is formed (electrostatic latent image forming step).

This electrostatic latent image is, for example, developed by the developing device 204Y for yellow (developing step), and then the toner image is transferred to the outer peripheral surface of the intermediate transfer member 207 by the primary transfer roller 205 (primary transfer step). At this time, the yellow toner or the like that is not transferred to the intermediate transfer member 207 and remains on the surface of the electrostatic latent image holding member 201, is cleaned by the cleaning apparatus 206.

Furthermore, the intermediate transfer member 207 having the yellow toner image formed on the outer peripheral surface, rotatingly moves in the direction reverse to the direction of the arrow D while retaining the yellow toner image on the outer peripheral surface (at this time, the apparatus is configured such that the electrostatic latent image holding member 201 and the intermediate transfer member 207 are separated).

Subsequently, the intermediate transfer member 207 is prepared at a position where, for example, a toner image of magenta color is laminated on the yellow toner image and transferred thereto.

Thereafter, also for the respective toners for magenta, cyan and black colors, the charging by the charging device 202, the irradiation of image light by the image writing device 203, the formation of toner images by 204M, 204C, and 204K, and the transfer of toner images to the outer peripheral surface of the intermediate transfer member 207 are sequentially repeated.

According to the exemplary embodiment of the invention, for example, in the case of forming a blue image, a cyan toner image formed on the electrostatic latent image holding member 201 is transferred by the developing device 204C onto the magenta toner image formed on the intermediate transfer member 207 through the developing step and the primary transfer step, in the manner such as disposed in the primary transfer step.

When the transfer of the toner images of two colors to the outer peripheral surface of the intermediate transfer member 207 is completed as such, these toner images are transferred altogether to the recording paper P by the secondary transfer roller 211 (secondary transfer step). Thereby, a recorded image of a cyan toner image and a magenta toner image laminated in order from the image forming surface, is obtained on the image forming surface of the recording paper P. After the toner image is transferred to the surface of the recording paper P by the secondary transfer roller 211, the transferred toner image is heated and fixed by the fixing apparatus 215 (fixing step).

The charging unit, electrostatic latent image holding member, electrostatic latent image forming unit, toner image forming unit, transfer unit, intermediate transfer member, cleaning unit, fixing unit and recording medium for the image forming apparatus 200 of FIG. 1 will be described below.

(Charging Unit)

As the charging device 202 which is a charging unit, for example, a charging device such as a corotron is used, but a conductive or semiconductive charging roller may also be used. In a contact type charging device using an electrically conductive or semiconductive charging roller, a direct current may be applied, or a direct current superposed on an alternating current may be applied, to the electrostatic latent image holding member 201. For example, the surface of the electrostatic latent image holding member 201 is charged by such a charging device 202, by generating a discharge in a microspace near the contact area with the electrostatic latent image holding member 201.

The surface of the electrostatic latent image holding member 201 is usually charged to from −300 V to −1000 V by the charging unit. Furthermore, the electrically conductive or semiconductive charging roller described above may have a single layer structure or a multilayer structure. A mechanism for cleaning the surface of the charging roller may also be provided.

(Electrostatic Latent Image Holding Member)

The electrostatic latent image holding member 201 has a function of allowing a latent image (electrostatic image) to be formed thereon. A suitable example of the electrostatic latent image holding member may be an electrophotographic photoreceptor. The electrostatic latent image holding member 201 has a photosensitive film including an organic photosensitive layer formed on the outer peripheral surface of a cylindrical conductive substrate. This photosensitive layer is composed of an undercoat layer formed as necessary on the surface of the substrate, a charge generating layer containing a charge generating material and a charge transport layer containing a charge transporting material formed thereon in this order. The lamination of the charge generating layer and the charge transport layer may be in a reverse order.

This is a multi-layer type photoreceptor in which a charge generating material and a charge transporting material are incorporated into separate layers (a charge generating layer and a charge transport layer), and the layers are laminated. However, the electrostatic latent image holding member may be a singlelayer type photoreceptor containing both the charge generating material and the charge transporting material in the same layer, and is desirably a multi-layer type photoreceptor. An intermediate layer may also be provided between the undercoat layer and the photosensitive layer. The photosensitive layer is not limited to an organic photosensitive layer, and photosensitive layers of other types such as an amorphous silicon photosensitive film may also be used.

(Electrostatic Latent Image Forming Unit)

The image writing apparatus 203, which is an electrostatic latent image forming unit, is not particularly limited, and an example thereof may be an optical instrument which exposes the surface of the electrostatic latent image holding member to a light source such as a semiconductor laser light, an LED light or a liquid crystal shutter light, in a desired image pattern.

(Toner Image Forming Unit)

The toner image forming unit has a function of developing the latent image formed on the electrostatic latent image holding member using a toner image forming agent containing a toner, and thereby forming a toner image. Such a toner image forming unit is not particularly limited as long as it has the function described above and may be selected according to the purpose, but examples include known developing devices having a function of attaching a toner for electrostatic latent image development to the electrostatic latent image holding member 201 using a brush, a roller or the like. At the time of development, the electrostatic latent image holding member 201 conventionally uses a direct current voltage, but a direct current voltage superposed on an alternating current voltage may also be used.

(Transfer Unit)

Examples of the transfer unit (according to the present exemplary embodiment, referring to both the primary transfer unit and the secondary transfer unit) include a unit which provides a charge having a polarity opposite to that of the toner on the toner image, from the backside of the recording medium, and thereby transferring the toner image to the surface of the recording medium by the effect of electrostatic force; and a transfer roller and a transfer roller pressing apparatus, which use an electrically conductive or semiconductive roller or the like that is brought into direct contact with the rear side of the recording medium and achieves transfer.

For the transfer roller, a direct current may be applied as the transfer current that is applied to the electrostatic latent image holding member, or a direct current superposed with an alternating current may also be applied. Various conditions and factors for the transfer roller may be set up in accordance with the width of the image region to be charged, the shape of the transfer charging device, the opening width, the process speed (circumferential velocity), and the like. A single layer foam roller or the like may be suitably used as the transfer roller, for the purpose of cost reduction.

(Intermediate Transfer Member)

The intermediate transfer member that may be used for the invention may be a known intermediate transfer member. Examples of the material used for the intermediate transfer member include a polycarbonate resin (PC), polyvinylidene fluoride (PVF), polyalkylene phthalate, a blend material of PC/polyalkylene terephthalate (PAT), and blend materials of an ethylene-tetrafluoroethylene copolymer (ETFE)/PC, ETFE/PAT, and PC/PAT. From the viewpoint of mechanical strength, an intermediate transfer belt using a thermosetting polyimide resin is desirable.

(Cleaning Unit)

In regard to the cleaning unit, any of a blade cleaning system, a brush cleaning system, or a roller cleaning system may be selected as long as it cleans residual toner on the electrostatic latent image holding member. Among these, it is desirable to use a cleaning blade. Furthermore, examples of the material for the cleaning blade include a urethane rubber, a neoprene rubber, and a silicone rubber. Among them, it is particularly desirable to use a polyurethane elastomer, which has excellent abrasion resistance.

In the case of using a toner having high transfer efficiency, an embodiment which does not use a cleaning unit is also acceptable.

(Fixing Unit)

The fixing unit (fixing apparatus) fixes the toner image transferred to the recording medium by applying heat, pressure, or heat and pressure to the toner image. In addition to the two-roll system used in the present exemplary embodiment, a belt-roll nip system in which the heating side or pressing side is in a belt shape, while the other is in a roller shape; and a two-belt system in which both the heating side and the pressing side are in a belt shape, may be used. Concerning the belt, a free belt system which uses the belt without applying tension thereto may also be used in addition to the system of applying tension to the belt using plural rollers. According to the present exemplary embodiment, any type of fixing apparatus may be used.

(Recording Medium)

Examples of the recording medium (recording paper) on which the toner image is transferred and thereby the final recorded image is formed, include ordinary paper that is used for copying machines, printers and the like of electrophotographic system, and an OHP sheet. In order to further enhance the smoothness of the image surface after fixing, it is desirable that the surface of the recording medium be as smooth as possible, and for example, a coated paper produced by coating the surface of ordinary paper with a resin or the like, an art paper for printing, and the like are suitably used.

According to the exemplary embodiment of the invention, examples of the ordinary paper include a paper having a smoothness of from 15 seconds to 80 seconds as measured according to JIS-P-8119, and a paper having a basis weight of 80 g/m$^2$ or less as measured according to JIS-P-8124. Examples of the coated paper include a paper having a coating layer on one surface of the paper substrate and having a smoothness of from 150 seconds to 1000 seconds.

Thus, the image forming apparatus of the exemplary embodiment of the invention has been described in detail with reference to preferred embodiments, but the exemplary embodiment is not intended to be limited to the embodiments described above. For example, the above exemplary embodiment illustrates an apparatus having a configuration whereby latent images of various colors are formed on one electrostatic latent image holding member 201 by a rotary developing apparatus 204 having a number of developing devices corresponding to the number of colors, and the latent images are transferred to the intermediate transfer member 207 for each of the latent images. However, use may also be made of an image forming apparatus which is generally called a tandem system, in which various color units each having electrostatic latent image holding members, charging units, toner image forming units, cleaning units and the like in a number corresponding to the number of colors, are arranged in parallel (may not be in a physically linear arrangement) to face the intermediate transfer medium, toner images of various colors formed by each of the units are primary transferred to the intermediate transfer medium and sequentially laminated, and the laminated toner images are altogether secondary transferred to the recording medium.

Furthermore, in the image forming apparatus of the exemplary embodiment, various configurations that are conventionally known or not known may be added to the apparatus, in addition to the constituent elements described above, and despite such addition, the resulting image forming apparatus is still included in the scope of the exemplary embodiment as long as the configuration of the image forming apparatus of the exemplary embodiment is maintained. For example, an erasing unit may be provided as a subsequent step of the cleaning unit. The erasing unit will be described in the section for the process cartridge.

In addition, a person having ordinary skill in the art may modify the image forming apparatus of the exemplary embodiment according to conventional knowledge. Despite such modification, the resulting image forming apparatus is still included in the scope of the exemplary embodiment as long as the configuration of the image forming apparatus of the exemplary embodiment is maintained.

<Toner Accommodating Container (Toner Cartridge)>

According to the exemplary embodiment, the toner accommodating container is a container including an accommodating portion which accommodates the magenta toner of the exemplary embodiment of the invention to supply the magenta toner to a toner image forming unit, and the container is detachable from an image forming apparatus having an electrostatic latent image holding member that is capable of holding an electrostatic latent image formed on the surface, a toner image forming unit that develops the electrostatic latent image formed on the surface of the electrostatic latent image holding member using a toner and forms a toner image on the surface of the electrostatic latent image holding member, and a transfer unit that transfers the toner image to a recording medium. The toner accommodating container is generally referred to as a "toner cartridge."

That is, in the exemplary embodiment shown in FIG. 1, the toner accommodating container is intended to accommodate the magenta toner of the exemplary embodiment to be supplied to the developing device 204M, and a magenta toner is accommodated in an appropriate container (not depicted). There are no particular limitations on the shape or material of such a container, but generally, the container is formed of a plastic material such as polystyrene, polypropylene, polycarbonate, or an ABS resin.

<Process Cartridge>

According to the exemplary embodiment, the "process cartridge" means an assembly of constituent elements, in which two or more constituent elements for an image forming apparatus are integrally equipped, and which is configured to be detachable from the main body of the image forming apparatus for the purpose of maintenance, repair, and regular replacement of consumable products. According to the exemplary embodiment, among the constituent elements for an image forming apparatus, the process cartridge includes an electrostatic latent image holding member and a toner image forming unit, while other constituent elements are optional.

Figure 2:
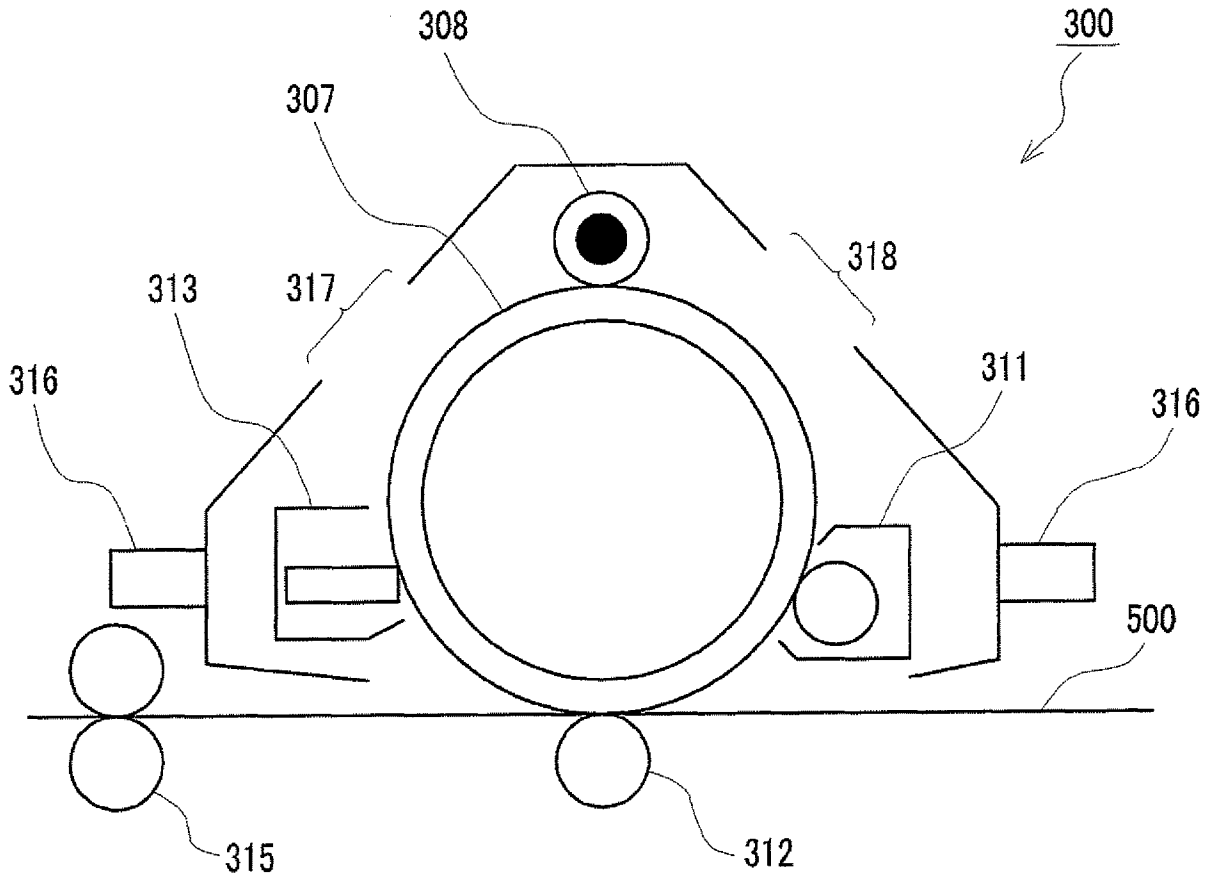
FIG. 2 is a schematic cross-sectional diagram showing the basic configuration of a suitable example of the process cartridge of the exemplary embodiment of the invention.

FIG. 2 is a schematic cross-sectional diagram schematically showing the basic configuration of a suitable example of the process cartridge of the exemplary embodiment. The process cartridge 300 shown in FIG. 2 includes, together with an electrostatic latent image holding member 307, a charging device (charging unit) 308, a developing apparatus (toner image forming unit) 311, and a cleaning apparatus (cleaning unit) 313, and an opening 318 for exposure and an opening 317 for erasing exposure are provided on the exterior, while an installation rail 316 is provided on the exterior. These elements are integrated into the process cartridge of the exemplary embodiment. In the developing apparatus 311, the magenta developer of the exemplary embodiment described above is accommodated.

This process cartridge 300 is a member detachably mounted on the main body of an image forming apparatus composed of a transfer apparatus 312, a fixing apparatus 315, and other constituent elements that are not depicted, and the process cartridge constitutes an image forming apparatus together with the main body of the image forming apparatus.

The electrostatic latent image holding member 307, the charging device (charging unit) 308, and the cleaning apparatus (cleaning unit) 313 have been described in the section for the exemplary embodiment of the image forming apparatus, and thus further description of the details will not repeated here, but the same units may also be used for the process cartridge 300.

Also, in the transfer apparatus 312 that transfers a toner image developed on the surface of the electrostatic latent image holding member 307 to a recording paper 500, the descriptions given on the topic of "transfer unit" collectively for the primary transfer unit and the secondary transfer unit in the section for the exemplary embodiment of the image forming apparatus, also apply to the process cartridge 300. Thus further description of the details will not be repeated here.

Examples of the erasing apparatus (photo erasing apparatus) (not depicted) include a tungsten lamp, and an LED. Examples of the type of light used in the photo charge removal process include white light from a tungsten lamp or the like, and red light from an LED light or the like. The irradiation light intensity in the photo charge removal process is usually set to be about several times to about 30 times the amount of light representing the half exposure sensitivity of the electrostatic latent image holding member.

In the process cartridge 300 of the present exemplary embodiment, light from such a photo erasing apparatus is received through the opening 317, and the charge on the surface of the electrostatic latent image holding member 307 is erased.

On the other hand, the imagewise exposure light from the exposure apparatus (exposure unit) (not depicted) is received through the opening 318 and is irradiated on the surface of the electrostatic latent image holding member 307 in the process cartridge 300 of the present exemplary embodiment, and thus an electrostatic latent image is formed.

The process cartridge 300 shown in FIG. 2 includes, together with an electrostatic latent image holding member 307 and a developing apparatus 311, a charging device 308, a cleaning apparatus 313, an opening 318 for exposure, and an opening 317 for erasing exposure. However, in the exemplary embodiment of the invention, these apparatuses may be selectively combined. The process cartridge of the exemplary embodiment includes development image forming units such as the electrostatic latent image holding member 307 and the developing apparatus 311 as essential constituent elements, and other constituent elements are optional.

The process cartridge of the exemplary embodiment as such is mounted on the image forming apparatus described above (desirably, a so-called tandem type image forming apparatus), and accommodates a magenta developer based on the exemplary embodiment, which gives excellent operating effects. Thus, the reproducible color gamut in the blue region is extended.

That is, the process cartridge of the image forming apparatus according to the exemplary embodiment of the invention may include an electrostatic latent image holding member that is capable of holding an electrostatic latent image formed on the surface, and a toner image forming unit that accommodates the magenta developer of the exemplary embodiment and also develops the electrostatic latent image formed on the surface of the electrostatic latent image holding member using a toner to form a toner image on the surface of the electrostatic latent image holding member, and the process cartridge is detachable from the image forming apparatus.

Further, the image forming apparatus according to the exemplary embodiment of the invention may include: the process cartridge of the exemplary embodiment of the invention that is detachable from the image forming apparatus, which has the electrostatic latent image holding member that is capable of holding an electrostatic latent image formed on the surface and the toner image forming unit that develops the electrostatic latent image formed on the surface of the electrostatic latent image holding member using a toner to form a toner image on the surface of the electrostatic latent image holding member; a charging unit that charges the surface of the electrostatic latent image holding member; an electrostatic latent image forming unit that forms an electrostatic latent image on the surface of the charged electrostatic latent image holding member; a transfer unit that transfers the toner image to a recording medium; and a fixing unit that fixes the transfer image transferred to the recording medium.

EXAMPLES

Hereinafter, the exemplary embodiments of the invention will be described in more detail based on Examples and Comparative Examples, but the exemplary embodiments are not intended to be limited to the following Examples. Unless particularly stated otherwise, the units "parts" and "percent (%)" are all on a mass basis.

<Measurement of Acid Value>

The acid value AV is measured by a neutralization titration method according to JIS K0070. That is, an appropriate amount of a sample is separated, and 160 ml of a solvent (acetone/toluene mixed liquid) and a few droplets of an indicator (phenolphthalein solution) are added to the sample. The mixture is sufficiently mixed in a water bath by shaking until the sample is completely dissolved. This solution is titrated with a 0.1 mol/l potassium hydroxide-ethanol solution, and the time point where the pink color of the indicator is maintained for 30 seconds is designated as the endpoint.

When the acid value is designated as AV, the sample amount as S (g), the amount of the 0.1 mol/l potassium hydroxide-ethanol solution used in the titration as B (ml), and the factor of the 0.1 mol/l potassium hydroxide-ethanol solution as f, the acid value is calculated by the formula:

$$AV=(B\times f\times 5.611)/S.$$

<Measurement Method for Glass Transition Temperature and Melting Temperature>

The glass transition temperature and the melting temperature are measured by a differential scanning calorimetric analysis according to ASTM D3418-8.

<Measurement of Mass Average Molecular Weight (Mw)>

The weight average molecular weights (Mw) of polyester resins (calculation relative to polystyrene) are determined by using HLC-8120GPC and SC-8020 apparatuses manufactured by Tosoh Corp. as a GPC apparatus, and using TSK-GEL, SUPERHM-H (6.0 mm ID×15 cm×2) columns and tetrahydrofuran (THF) for chromatographic use manufactured by Wako Pure Chemical Industries, Ltd. as an eluent. The experiment conditions include a sample concentration of 0.5%, a flow rate of 0.6 ml/min, a sample injection amount of 10 and a measurement temperature of 40° C., and a calibration curve is produced from 10 samples of A-500, F-1, F-10, F-80, F-380, A-2500, F-4, F-40, F-128, and F-700. Furthermore, the data collection interval in the sample analysis is 300 ms.

<Calculation of Shape Factor SF1>

The analysis of the shape factor of a toner is carried out using FPIA-3000 (manufactured by Sysmex Corp.). A toner dispersion liquid for the analysis is prepared as follows. First, 30 ml of ion-exchanged water is placed in a 100-ml beaker, and two droplets of a surfactant (CONTAMINON, manufactured by Wake Pure Chemical Industries, Ltd.) as a dispersant are added dropwise to the ion-exchanged water. 20 mg of the toner is put into this liquid, and the mixture is dispersed for 3 minutes by ultrasonic dispersion. Thus, a dispersion liquid is prepared.

The toner dispersion liquid thus obtained is subjected to an analysis on the shape factor of 4,500 particles using the FPIA-3000. Thus, the shape factor is calculated.

<Method for Measuring Toner Volume Average Particle Size>

The volume average particle size of the toner particles is measured using a MULTISIZER II (manufactured by Beckman Coulter, Inc.). ISOTON-II (manufactured by Beckman Coulter, Inc.) is used as the electrolytic liquid.

<Analysis of Toner Particle Size Distribution>

The analysis for the particle size distribution index for a toner is carried out by plotting cumulative distributions for the volume and the number, from the smaller diameter side, with respect to the particle size range (channel) divided on the basis of the particle size distribution measured using a Multisizer II. The particle size of cumulative 16% by volume is designated as $D_{16V}$, the particle size of cumulative 16% by number as $D_{16P}$, the particle size of cumulative 50% by volume as $D_{50V}$, the particle size of cumulative 50% by number as $D_{50P}$, the particle size of cumulative 84% by volume as $D_{84V}$, and the particle size of cumulative 84% by number as $D_{84P}$.

Using these measurement values, the volume average particle size distribution index (GSDv) is calculated from the formula: $(D_{84V}/D_{16V})^{1/2}$, the number average particle size distribution index (GSDp) from the formula: $(D_{84P}/D_{16P})^{1/2}$, and the lower number average particle size distribution index (GSDp lower) from the formula: $(D_{50P}/D_{16P})^{1/2}$.

<Preparation of Magenta Pigment Dispersion Liquid 1>

Solid solution pigment of C.I. Pigment Violet 19 and C.I. Pigment Red 122 (manufactured by DIC Corporation; FASTOGEN SUPER MAGENTA RE05): 200 parts Anionic surfactant (manufactured by Daiichi Kogyo Seiyaku Co., Ltd.; NEOGEN SC): 33 parts (active ingredient 60%, 10% based on colorant)

Ion-exchanged water: 750 parts

In a stainless steel vessel having a size such that when the entire amount of the components shown above are put, the level of the meniscus is about one-third of the height of the vessel, 280 parts of ion-exchanged water and 33 parts of the anionic surfactant are put, and the surfactant is sufficiently dissolved therein. Subsequently, all of the solid solution pigment is put into the vessel, and the mixture is stirred using a stirrer until unwetted pigment is no longer seen, while the mixture is sufficiently degassed. After degassing, the rest of the ion-exchanged water is added, and the system is dispersed using a homogenizer (manufactured by TKA Werke GmbH, ULTRA TURRAX T50) at 5000 rpm for 10 minutes, and then the dispersion liquid is degassed by stirring for one whole day and night using a stirrer. After degassing, the dispersion liquid is dispersed again using a homogenizer at 6000 rpm for 10 minutes, and then is degassed by stirring for one whole day and night using a stirrer. Subsequently, the dispersion liquid is dispersed under a pressure of 240 MPa using a high pressure impact type dispersing machine, ULTIMIZER (manufactured by Sugino Machine, Ltd.; HJP30006). The dispersion is carried out to an extent equivalent to 25 passes in terms of the total feed amount and the processing capability of the apparatus. The dispersion thus obtained is left to stand for 72 hours to remove any precipitate, and ion-exchanged water is added thereto to adjust the solids concentration to 15%. The volume average particle size D50 of the particles in this magenta pigment dispersion liquid 1 is 135 nm. As the volume average particle size D50, an average value of three measurement values obtained by making five measurements with a MICROTRAC, and excluding the largest value and the smallest value, is used.

<Preparation of Magenta Pigment Dispersion Liquid 2>

A magenta pigment dispersion liquid 2 is prepared in the same manner as in the preparation of the magenta pigment dispersion liquid 1, except that the magenta pigment is changed to C.I. Pigment Red 269 (manufactured by DIC Corporation; SYMULER FAST RED 1022).

The volume average particle size D50 of the particles in this magenta pigment dispersion liquid 2 is 155 nm.

<Preparation of Yellow Pigment Dispersion Liquid>

A yellow pigment dispersion liquid is prepared in the same manner as in the preparation of the magenta pigment dispersion liquid 1, except that the magenta pigment is changed to C.I. Pigment Yellow 185 (manufactured by BASF Corp.; PALIOTOL YELLOW D1155).

The volume average particle size D50 of the particles in this yellow pigment dispersion liquid is 170 nm.

<Preparation of Cyan Pigment Dispersion Liquid>

A cyan pigment dispersion liquid is prepared in the same manner as in the preparation of the magenta pigment dispersion liquid 1, except that the magenta pigment is changed to C.I. Pigment Blue 15:3 (manufactured by BASF Corp.; HELIOGEN BLUE D7092).

The volume average particle size D50 of the particles in this cyan pigment dispersion liquid is 130 nm.

<Preparation of Release Agent Dispersion Liquid 1>

Hydrocarbon-based wax (manufactured by Nippon Seiro Co., Ltd.; trade name: FNP0080, melting temperature=80° C.) 270 parts Anionic surfactant (manufactured by Daiichi Kogyo Seiyaku Co., Ltd., NEOGENRK, active ingredient content: 60%): 13.5 parts (in terms of active ingredient, 3.0% based on the release agent)

Ion-exchanged water: 21.6 parts

The above components are mixed, and the release agent is dissolved using a pressure discharge homogenizer (manufactured by Gaulin, Inc.; Gaulin Homogenizer) at an internal liquid temperature of 120° C. Subsequently, the mixture is subjected to a dispersion treatment for 120 minutes at a dispersion pressure of 5 MPa, and for 360 minutes at a dispersion pressure of 40 MPa, and is cooled. Thus, a release agent dispersion liquid 1 is obtained. The volume average particle size D50 of the particles in this release agent dispersion liquid is 225 nm. Subsequently, ion-exchanged water is added thereto to adjust the solids concentration to 20.0%.

<Preparation of Release Agent Dispersion Liquid 2>

A release agent dispersion liquid 2 is obtained in the same manner as in the preparation of the release agent dispersion liquid 1, except that the release agent is changed to a hydrocarbon-based wax (manufactured by Nippon Seiro Co., Ltd.; trade name: NHP5, melting temperature=62° C.). The volume average particle size D50 of the particles in this release agent dispersion liquid is 230 nm.

<Preparation of Release Agent Dispersion Liquid 3>

A release agent dispersion liquid 3 is obtained in the same manner as in the preparation of the release agent dispersion liquid 1, except that the release agent is changed to a hydrocarbon-based wax (manufactured by Toyo Petrolite Co., Ltd.; trade name: POLYWAX 655, melting temperature=98° C.). The volume average particle size D50 of the particles in this release agent dispersion liquid is 230 nm.

<Preparation of Release Agent Dispersion Liquid 4>

A release agent dispersion liquid 4 is obtained in the same manner as in the preparation of the release agent dispersion liquid 1, except that the release agent is changed to a hydrocarbon-based wax (manufactured by Kao Corp.; trade name: EXCEL P405, melting temperature=58° C.). The volume average particle size D50 of the particles in this release agent dispersion liquid is 210 nm.

<Preparation of Release Agent Dispersion Liquid 5>

A release agent dispersion liquid 5 is obtained in the same manner as in the preparation of the release agent dispersion liquid 1, except that the release agent is changed to a hydrocarbon-based wax (manufactured by Toyo Petrolite Co., Ltd.; trade name: POLYWAX 725, melting temperature=102° C.) The volume average particle size D50 of the particles in this release agent dispersion liquid is 220 nm.

<Synthesis of Amorphous Polyester Resin 1>

Bisphenol A ethylene oxide 2.2-mol adduct: 40 mol %

Bisphenol A propylene oxide 2.2-mol adduct: 60 mol %

Terephthalic acid: 47 mol %

Fumaric acid: 40 mol %

Dodecenylsuccinic anhydride: 15 mol %

Trimellitic anhydride: 3 mol %

The monomer components described above except for Fumaric acid and trimellitic anhydride, and 0.25 part of tin dioctanoate based on 100 parts of the total amount of the monomer components, are put into a reaction vessel equipped with a stirrer, a thermometer, a condenser and a nitrogen gas inlet tube. The monomers are allowed to react for 6 hours at 235° C. under a nitrogen gas stream, and then the temperature is dropped to 200° C. Fumaric acid and trimellitic anhydride are added to the system, and the mixture is allowed to react for one hour. The temperature is further increased to 220° C. over 4 hours, and under a pressure of 10 kPa, polymerization is carried out until a desired molecular weight is obtained. Thus, a pale yellow, transparent amorphous polyester resin 1 is obtained.

The amorphous polyester resin 1 thus obtained has a glass transition temperature Tg of 59° C. as obtained by DSC, a mass average molecular weight Mw of 25,000 as obtained by GPC, a number average molecular weight Mn of 7,000, a softening temperature of 107° C. as obtained by a flow tester, and an acid value AV of 13 mg KOH/g.

<Preparation of Amorphous Polyester Resin Dispersion Liquid 1>

While a 3-liter jacketed reaction tank (manufactured by Tokyo Rikakikai Co., Ltd.; BJ-30N) equipped with a condenser, a thermometer, a water-dropping apparatus, and an anchor blade is maintained at 40° C. in a water-circulating constant temperature bath, a mixed solvent of 160 parts of ethyl acetate and 100 parts of isopropyl alcohol is put into the reaction tank, and 300 parts of the amorphous polyester resin 1 is put into the mixed solvent. The mixture is stirred at 150 rpm using a Three-One motor and is dissolved to obtain an oil phase. 14 parts of a 10% aqueous ammonia solution is added dropwise for a dropping time of 5 minutes to the oil phase that is still being stirred, and the mixture is mixed for 10 minutes. 900 parts of ion-exchanged water is further added dropwise thereto at a rate of 7 parts per minute to reverse the phase, and thus an emulsion is obtained.

Immediately, 800 parts of the emulsion thus obtained and 700 parts of ion-exchanged water are placed in a 2-liter pear-shaped flask, and the flask is mounted on an evaporator (manufactured by Tokyo Rikakikai Co., Ltd.) equipped with a vacuum control unit with a trap ball. While the pear-shaped flask is rotated, the temperature is increased in a hot water bath at 60° C. While caution is taken not to have abrupt boiling, the pressure is reduced to 7 kPa, and the solvent is removed. At a time point when the amount of recovered solvent is 1,100 parts, the pressure is returned to normal pressure, and the pear-shaped flask is water-cooled to obtain a dispersion liquid. The dispersion liquid thus obtained has no solvent odor. The volume average particle size D50 of the resin particles in this dispersion liquid is 130 nm. Subsequently, ion-exchanged water is added to adjust the solids concentration to 20%, and the resultant is designated as an amorphous polyester resin dispersion liquid 1.

<Synthesis of Amorphous Polyester Resin 2>

Bisphenol A propylene oxide adduct (manufactured by Sanyo Chemical Industries, Ltd.; NEWPOL BP-2P): 80 mol %

Bisphenol A ethylene oxide adduct (manufactured by Sanyo Chemical Industries, Ltd.; NEWPOL BPE-20): 20 mol %

Terephthalic acid (reagent): 70 mol %

Cyclohexanedicarboxylic acid (reagent): 30 mol %

The components described above are put into a reaction vessel equipped with a stirrer, a thermometer, a condenser and a nitrogen gas inlet tube, and the reaction vessel is purged with dry nitrogen gas. Subsequently, 0.25 part of tin dioctanoate based on 100 parts of the total amount of the monomer components is put into the reaction vessel. Under a nitrogen gas stream, the monomers are allowed to react under stirring for about 6 hours at about 180° C., and the temperature is further increased to about 220° C. over one hour, and the reaction is carried out under stirring for about 7.0 hours. The temperature is further increased to 235° C., the pressure inside the reaction vessel is decreased to 10.0 mmHg, and the reaction is carried out under stirring under reduced pressure for about 2.0 hours. Thus, a pale yellow, transparent amorphous polyester resin 2 is obtained.

The amorphous polyester resin 2 thus obtained has a glass transition temperature Tg of 52.5° C. as obtained by DSC, amass average molecular weight Mw of 18,000 as obtained by GPO, a number average molecular weight Mn of 6,300, and an acid value AV of 9.3 mg KOH/g.

<Preparation of Amorphous Polyester Resin Dispersion Liquid 2>

An amorphous polyester resin dispersion liquid 2 is obtained in the same manner as in the preparation of the amorphous polyester resin dispersion liquid 1. The volume average particle size D50 of the resin particles in this dispersion liquid is 130 nm.

<Preparation of Styrene-Based Polymer Dispersion Liquid>

Styrene: 480 parts
n-butyl acrylate: 119 parts
Dodecanethiol: 9.4 parts
Decanediol diacrylate: 4.2 parts
Ion-exchanged water: 250 parts
Anionic surfactant: 12 parts The components described above are mixed and dissolved to prepare a mixed solution A. Meanwhile, 1 part of an anionic surfactant (manufactured by Rhodia, Inc.; DOWFAX) is dissolved in 550 parts of ion-exchanged water, and 430 parts of the mixed solution A is added thereto. The mixture is dispersed in the flask and emulsified. Subsequently, 9 parts of ammonium persulfate is dissolved in 52 parts of ion-exchanged water, and this solution is put into the emulsion in the flask. The system is sufficiently purged with nitrogen, and then while stirred, the flask is heated in an oil bath until the temperature inside the system reaches 70° C. Emulsion polymerization is continued as such for 2 hours. Furthermore, a liquid obtained by adding 5 parts of dodecanethiol to 444.6 parts of the mixed solution A and dispersing the mixture to emulsify, is added to the system, and emulsion polymerization is carried out for 3 hours at 70° C. Thus, a dispersion liquid having fine particles having a center diameter of 178 nm, a glass transition temperature of 58.2° C., a mass average molecular weight of 38,000, and a solids content of 42% is obtained. Subsequently, ion-exchanged water is added thereto to adjust the solids concentration to 20%, and this is designated as a styrene-based polymer dispersion liquid.

<Synthesis of Crystalline Polyester Resin>

1,10-Dodecanedioic acid; 50 mol %
1,9-Nonanediol: 50 mol %

The monomer components described above are put into a reaction vessel equipped with a stirrer, a thermometer, a condenser and a nitrogen gas inlet tube, and the reaction vessel is purged with dry nitrogen gas. Subsequently, titanium tetrabutoxide (reagent) is added thereto in an amount of 0.25 part based on 100 parts of the monomer components. Under a nitrogen gas stream, the mixture is allowed to react under stirring at 170° C. for 3 hours, and then the temperature is further increased to 210° C. over one hour. The pressure inside the reaction vessel is decreased to 3 kPa, and the reaction is carried out under stirring under reduced pressure for 13 hours. Thus, a crystalline polyester resin is obtained.

The crystalline polyester resin thus obtained has a melting temperature of 73.6° C. as obtained by DSC, amass average molecular weight Mw of 25,000 as obtained by GPC, a number average molecular weight Mn of 10,500, and an acid value AV of 10.1 mg KOH/g.

<Preparation of Crystalline Polyester Resin Dispersion Liquid>

In a jacketed 3-liter reaction tank (manufactured by Tokyo Rikakikai Co., Ltd.: BJ-30N) equipped with a condenser, a thermometer, a water-dropping apparatus, and an anchor blade, 300 parts of the crystalline polyester resin, 160 parts of methyl ethyl ketone (solvent), and 100 parts of isopropyl alcohol (solvent) are put. While the mixture is maintained at 70° C. in a water-circulating constant temperature bath, the resin is dissolved by mixing under stirring at 100 rpm (solution preparation step).

Subsequently, the speed of rotation for stirring is set to 150 rpm, and the temperature of the water-circulating constant temperature bath is set to 66° C. 17 parts of 10% aqueous ammonia (reagent) is put into the solution over 10 minutes, and then ion-exchanged water that is kept warm at 66° C. is added dropwise thereto at a rate of 7 parts/min in a total amount of 900 parts to reverse the phase. Thus, an emulsion is obtained.

Immediately, 800 parts of the emulsion thus obtained and 700 parts of ion-exchanged water are put into a 2-liter pear-shaped flask, and the flask is mounted on an evaporator (manufactured by Tokyo Rikakikai Co., Ltd.) equipped with a vacuum control unit with a trap ball. While the pear-shaped flask is rotated, the temperature is increased in a hot water bath at 60° C. While caution is taken not to have abrupt boiling, the pressure is reduced to 7 kPa, and the solvent is removed. At a time point when the amount of recovered solvent is 1,100 parts, the pressure is returned to normal pressure, and the pear-shaped flask is water-cooled to obtain a dispersion liquid. The dispersion liquid thus obtained has no solvent odor. The volume average particle size D50v of the resin particles in this dispersion liquid is 130 nm. Subsequently, ion-exchanged water is added to adjust the solids concentration to 20%, and the resultant is designated as a crystalline polyester resin dispersion liquid.

<Preparation of Aqueous Solution of Aluminum Sulfate>

Aluminum sulfate powder (manufactured by Asada Chemical Industry co., Ltd.; 17% aluminum sulfate): 35 parts
Ion-exchanged water: 1,965 parts The above components are put into a 2-liter vessel and are mixed under stirring at 30° C. until precipitates disappear. Thus, an aqueous solution of aluminum sulfate is prepared.

Example 1

<Preparation of Magenta Toner>

Amorphous polyester resin dispersion liquid 1: 700 parts
Magenta pigment dispersion liquid 1: 133 parts
Release agent dispersion liquid 1: 100 parts
Crystalline polyester resin dispersion liquid: 50 parts
Ion-exchanged water: 350 parts
Anionic surfactant (manufactured by Dow Chemical Company, DOWFAX 2A1): 2.9 parts The above components are put into a 3-liter reaction vessel equipped with a thermometer, a pH meter and a stirrer, and 1.0% nitric acid is added thereto at a temperature of 25° C. to adjust the pH to 3.0. Subsequently, while the mixture is dispersed at 5,000 rpm using a homogenizer (manufactured by IKA Japan K.K.; ULTRA TURRAX T50), 130 parts of the prepared aqueous solution of aluminum sulfate is added to the reaction vessel, and the mixture is dispersed for 6 minutes.

Subsequently, the reaction vessel is provided with a stirrer and a mantle heater, and while the speed of rotation of the stirrer is adjusted so that the slurry is sufficiently stirred, the temperature is increased at a rate of 0.2° C./min up to a temperature of 40° C., and is increased at a rate of 0.05° C./min after 40° C. The particle size is measured every 10 minutes using a MULTISIZER II (aperture diameter: 50 μm, manufactured by Beckman Coulter, Inc.). When the volume average particle size reaches 5.0 μm, the temperature is maintained, 50 parts of the amorphous polyester resin dispersion liquid 1 is added thereto over 5 minutes.

The system is maintained for 30 minutes, and then the pH is adjusted to 9.0 using a 1% aqueous solution of sodium hydroxide. Subsequently, while the pH is similarly adjusted to 9.0 at every increment of 5° C., the temperature is increased to 90° C. at a rate of temperature increase of 1° C./min, and the system is maintained at 90° C. The particle shape and the surface properties are observed every 15 minutes using an optical microscope and a scanning electron microscope (FE- SEM), and coalescence of particles is confirmed after 2.0 hours. The vessel is cooled to 30° C. in cooling water for 5 minutes.

The slurry obtained after cooling is passed through a nylon mesh having a mesh size of 15 μm, and coarse particles are removed. Nitric acid is added to the toner slurry that has passed through the mesh, to adjust the toner slurry to pH 6.0, and then the slurry is subjected to reduced pressure filtration using an aspirator. The toner left on the filter paper is crushed with the hand as finely as possible, and the crushed toner is put into ion-exchanged water in an amount equivalent to ten times the amount of the toner at a temperature of 30° C. The mixture is mixed under stirring for 30 minutes, and then is subjected again to reduced pressure filtration with an aspirator. The electrical conductivity of the filtrate is measured. This operation is repeated until the electrical conductivity of the filtrate reaches not higher than 10 μS/cm, and the toner is washed.

The washed toner is pulverized as finely as possible with a wet/dry granulator (COMIL), and then is dried in vacuo in an oven at 35° C. for 36 hours. Thus, toner particles are obtained. 1.0 part of hydrophobic silica (manufactured by Nippon Aerosil Co., Ltd., RY50) is added to 100 parts of the toner particles thus obtained, and the mixture is mixed and blended for 30 seconds at 13,000 rpm using a sample mill. Subsequently, the particles are sieved with a vibration screen having a mesh size of 45 μm, and thus a magenta toner is obtained.

The magenta toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed.

<Preparation of Resin-Coated Carrier>

Mn—Mg—Sr-based ferrite particles (average particle size 40 μm): 100 parts

Toluene: 14 parts

Cyclohexyl methacrylate/dimethylaminoethyl methacrylate copolymer (copolymerization weight ratio 99:1, Mw: 80,000): 2.0 parts Carbon black (VXC72: manufactured by Cabot Corp.): 0.12 part The components described above except for ferrite particles, and glass beads (φ 1 mm, in an amount equal to that of toluene) are stirred using a sand mill manufactured by Kansai Paint Co., Ltd. for 30 minutes at 1200 rpm, and thus a solution for resin coating layer formation is obtained. Furthermore, this solution for resin coating layer formation and ferrite particles are put into a vacuum degassing kneader, and toluene is distilled off under reduced pressure to dry the components. Thus, a resin-coated carrier is prepared.

<Preparation of Magenta Developer>

40 parts of the magenta toner is added to 500 parts of the resin-coated carrier, and the mixture is blended with a V-type blender for 20 minutes. Subsequently, aggregates are removed using a vibration screen having a mesh size of 212 μm, and thus a magenta developer is prepared.

A yellow toner is obtained in the same manner as in the preparation of the magenta toner of Example 1, except that the magenta pigment dispersion liquid is changed to the yellow pigment dispersion liquid. The yellow toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed. Subsequently, a yellow developer is prepared in the same manner as in the preparation of the magenta developer.

A cyan toner is obtained in the same manner as in the preparation of the magenta toner of Example 1, except that the magenta pigment dispersion liquid is changed to the cyan pigment dispersion liquid. The cyan toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed. Subsequently, a cyan developer is prepared in the same manner as in the preparation of the magenta developer.

Example 2

A magenta toner is obtained in the same manner as in the preparation of the magenta toner of Example 1, except that the release agent dispersion liquid 1 is changed to the release agent dispersion liquid 2. The magenta toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed. Subsequently, a magenta developer is prepared in the same manner as in the preparation of the magenta developer of Example 1.

Example 3

A magenta toner is obtained in the same manner as in the preparation of the magenta toner of Example 1, except that the release agent dispersion liquid 1 is changed to the release agent dispersion liquid 3. The magenta toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed. Subsequently, a magenta developer is prepared in the same manner as in the preparation of the magenta developer of Example 1.

Example 4

A magenta toner is obtained in the same manner as in the preparation of the magenta toner of Example 1, except that the release agent dispersion liquid 1 is changed to the release agent dispersion liquid 4. The magenta toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed. Subsequently, a magenta developer is prepared in the same manner as in the preparation of the magenta developer of Example 1.

Example 5

A magenta toner is obtained in the same manner as in the preparation of the magenta toner of Example 1, except that the release agent dispersion liquid 1 is changed to the release agent dispersion liquid 5. The magenta toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed. Subsequently, a magenta developer is prepared in the same manner as in the preparation of the magenta developer of Example 1.

Example 6

A magenta toner is obtained in the same manner as in the preparation of the magenta toner of Example 1, except that the composition is changed as follows.

Amorphous polyester resin dispersion liquid 1: 600 parts
Magenta pigment dispersion liquid 1: 133 parts
Magenta pigment dispersion liquid 2: 133 parts
Release agent dispersion liquid 1: 100 parts
Crystalline polyester resin dispersion liquid: 50 parts
Ion-exchanged water: 350 parts
Anionic surfactant (manufactured by Dow Chemical Company, DOWFAX 2A1): 2.9 parts The magenta toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed. Subsequently, a magenta developer is prepared in the same manner as in the preparation of the magenta developer of Example 1.

Example 7

A magenta toner is obtained in the same manner as in the preparation of the magenta toner of Example 1, except that the composition is changed as follows.

Amorphous polyester resin dispersion liquid 1: 760 parts
Magenta pigment dispersion liquid 1: 53 parts
Release agent dispersion liquid 1: 100 parts
Crystalline polyester resin dispersion liquid: 50 parts
Ion-exchanged water: 350 parts
Anionic surfactant (manufactured by Dow Chemical Company, DOWFAX 2A1): 2.9 parts The magenta toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed. Subsequently, a magenta developer is prepared in the same manner as in the preparation of the magenta developer of Example 1.

Example 8

A magenta toner is obtained in the same manner as in the preparation of the magenta toner of Example 1, except that the composition is changed as follows.

Amorphous polyester resin dispersion liquid 1: 500 parts
Magenta pigment dispersion liquid 1: 400 parts
Release agent dispersion liquid 1: 100 parts
Crystalline polyester resin dispersion liquid: 50 parts
Ion-exchanged water: 350 parts
Anionic surfactant (manufactured by Dow Chemical Company, DOWFAX 2A1): 2.9 parts The magenta toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed. Subsequently, a magenta developer is prepared in the same manner as in the preparation of the magenta developer of Example 1.

Example 9

A magenta toner is obtained in the same manner as in the preparation of the magenta toner of Example 1, except that the composition is changed as follows.

Amorphous polyester resin dispersion liquid 1: 750 parts
Magenta pigment dispersion liquid 1: 133 parts
Release agent dispersion liquid 1: 100 parts
Ion-exchanged water: 350 parts
Anionic surfactant (manufactured by Dow Chemical Company, DOWFAX 2A1): 2.9 parts The magenta toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed. Subsequently, a magenta developer is prepared in the same manner as in the preparation of the magenta developer of Example 1.

Example 10

A magenta toner is obtained in the same manner as in the preparation of the magenta toner of Example 1, except that the composition is changed as follows.

Amorphous polyester resin dispersion liquid 1: 650 parts
Magenta pigment dispersion liquid 1: 133 parts
Release agent dispersion liquid 1: 100 parts
Crystalline polyester resin dispersion liquid: 100 parts
Ion-exchanged water: 350 parts
Anionic surfactant (manufactured by Dow Chemical Company, DOWFAX 2A1): 2.9 parts The magenta toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed. Subsequently, a magenta developer is prepared in the same manner as in the preparation of the magenta developer of Example 1.

Comparative Example 1

Styrene-based polymer dispersion liquid: 700 parts
Magenta pigment dispersion liquid 1: 133 parts
Releasing dispersion liquid 1: 100 parts
Crystalline polyester resin dispersion liquid: 50 parts
Ion-exchanged water: 350 parts
Polyaluminum chloride (10% aqueous solution): 3.2 parts The components described above are sufficiently mixed and dispersed with a homogenizer (manufactured by IKA Werke GmbH, ULTRA TURRAX T50) in a round flask made of stainless steel, and then the flask is heated to 52° C. in an oil bath for heating while the content of the flask is stirred. After the flask is maintained at 52° C. for 60 minutes, 50 parts of the styrene-based polymer dispersion liquid is added thereto, and the mixture is gently stirred. Subsequently, the pH in the system is adjusted to 6.5 using a 0.5 mol/liter aqueous solution of sodium hydroxide, and then the stainless steel flask is sealed. While stirring is continued using a magnetic seal, the flask is heated to 95° C. and maintained for 4 hours. After completion of the reaction, the reaction liquid is cooled, filtered, and sufficiently washed with ion-exchanged water. Subsequently, the reaction liquid is subjected to solid-liquid separation by Nutsche suction filtration. The filter cake is redispersed in 3 liters of ion-exchanged water at 40° C., and the dispersion is stirred for 15 minutes at 300 rpm and washed. This washing operation is repeated five times, and the filtrate acquires a pH of 6.56, an electrical conductivity of 7.1 μS/can, and a surface tension of 71.0 mN/m. The dispersion is subjected to solid-liquid separation by Nutsche suction filtration using a No. 5A filter paper, and then the solids are continuously vacuum dried for 12 hours. Thus, toner particles are obtained. The washed toner is finely pulverized using a wet/dry granulator (Comil) and is dried in vacuo in an oven at 35° C. for 36 hours. Thus, toner particles are obtained. 1.0 part of hydrophobic silica (manufactured by Nippon Aerosil Co., Ltd., RY50) is added to 100 parts of the toner particles thus obtained, and the mixture is mixed and blended for 30 seconds at 13,000 rpm using a sample mill. Thereafter, the particles are sieved through a vibration screen having a mesh size of 45 μm, and thus a magenta toner is obtained.

The magenta toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed. Subsequently, a magenta developer is prepared in the same manner as in the preparation of the magenta developer of Example 1.

Comparative Example 2

A magenta toner is obtained in the same manner as in the preparation of the magenta toner of Example 1, except that the amorphous polyester resin dispersion liquid 1 is changed to the amorphous polyester resin dispersion liquid 2. The magenta toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed. Subsequently, a magenta developer is prepared in the same manner as in the preparation of the magenta developer of Example Comparative Example 3

A magenta toner is obtained in the same manner as in the preparation of the magenta toner of Example 1, except that the composition is changed as follows.

Amorphous polyester resin dispersion liquid 1: 827 parts
Magenta pigment dispersion liquid 1: 24 parts
Release agent dispersion liquid 1: 100 parts
Crystalline polyester resin dispersion liquid: 56 parts
Ion-exchanged water: 350 parts
Anionic surfactant (manufactured by Dow Chemical Company, DOWFAX 2A1): 2.9 parts The magenta toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed. Subsequently, a magenta developer is prepared in the same manner as in the preparation of the magenta developer of Example 1.

Comparative Example 4

A magenta toner is obtained in the same manner as in the preparation of the magenta toner of Example 1, except that the composition is changed as follows.

Amorphous polyester resin dispersion liquid 1: 490 parts
Magenta pigment dispersion liquid 1: 413 parts
Release agent dispersion liquid 1: 100 parts
Crystalline polyester resin dispersion liquid: 50 parts
Ion-exchanged water: 350 parts
Anionic surfactant (manufactured by Dow Chemical Company, DOWFAX 2A1): 2.9 parts The magenta toner thus obtained has a volume average particle size D50 of 6.0 μm, and a shape factor SF1 of 0.960 (manufactured by Sysmex Corp., FPIA-3000). An observation of SEM images of the toner is made, and it is found that the toner particles have smooth surfaces, and defects such as protrusion of the release agent or peeling of the surface layer are not observed. Subsequently, a magenta developer is prepared in the same manner as in the preparation of the magenta developer of Example 1.

In the following, the amount of the solid solution based on the total mass of the toner, the proportion of the crystalline polyester (PE) resin in the binder resin, and the melting temperatures of the release agent (wax) and the crystalline polyester resin for Examples 1 to 10 and Comparative Examples 1 to 4 are summarized in Table 1.

TABLE 1

| | Amount of solid solution | Proportion of crystalline PE in binder resin | Melting temperature of wax | Melting temperature of crystalline PE |
|---|---|---|---|---|
| Example 1 | 10% | 6.3% | 80° C. | 73.6° C. |
| Example 2 | 10% | 6.3% | 62° C. | 73.6° C. |
| Example 3 | 10% | 6.3% | 98° C. | 73.6° C. |
| Example 4 | 10% | 6.3% | 58° C. | 73.6° C. |
| Example 5 | 10% | 6.3% | 102° C. | 73.6° C. |
| Example 6 | 10% | 7.1% | 80° C. | 73.6° C. |
| Example 7 | 4% | 5.8% | 80° C. | 73.6° C. |
| Example 8 | 30% | 8.3% | 80° C. | 73.6° C. |
| Example 9 | 10% | 0% | 80° C. | — |
| Example 10 | 10% | 12.5% | 80° C. | 73.6° C. |
| Comp. Ex. 1 | 10% | 6.3% | 80° C. | 73.6° C. |
| Comp. Ex. 2 | 10% | 6.3% | 80° C. | 73.6° C. |
| Comp. Ex. 3 | 1.7% | 6.0% | 80° C. | 73.6° C. |
| Comp. Ex. 4 | 31% | 8.5% | 80° C. | 73.6° C. |

<Evaluation>

—Color Gamut Evaluation (Monochromatic)—

In a chamber under an environment at a temperature of 25° C. and a humidity of 60%, the main body, developing device and toner cartridge of a DocuCentre Color 400 CP manufactured by Fuji Xerox Co., Ltd., are cleaned by sufficiently removing the developer and toner that have been mounted thitherto, and the developers produced in the invention are put into the developing device, while toners for replenishment are respectively put into the toner cartridges.

Subsequently, the amount of the developing toner for a 100% simple color (magenta color) image on OK OVERCOAT paper is adjusted to 4.0 g/m$^2$, and an image having a size of 5 cm×5 cm and formed from a magenta toner only is produced. The image density (L*) and color saturation (c*=

$(a^{*2}+b^{*2})^{0.5}$) thus obtained are measured. For the measurement, measurements are made at 10 sites randomly selected within the image area using X-RITE 939 (aperture 4 mm), and an average value is determined. The density results and the color saturation results are shown in Table 2.

The evaluations are carried out based on the following criteria.

(Image Density)

G5: Less than 44

G4: Equal to or greater than 44 and less than 46

G3: Equal to or greater than 46 and less than 48

G2: Equal to or greater than 48 and less than 50

G1: Equal to or greater than 50

For the image density (L*), a smaller value corresponds to a higher density, and grades G2 to G5 represent acceptable ranges.

(Chroma)

G5: Equal to or greater than 79

G4: Equal to or greater than 76 and less than 79

G3: Equal to or greater than 73 and less than 76

G2: Equal to or greater than 70 and less than 73

G1: Less than 70

For the color saturation (c*), a larger value corresponds to a higher chroma, and grades G2 to G5 represent acceptable ranges.

—Color Gamut Evaluation (Secondary Colors)—

The amount of the developing toner for each of 100% simple color images on OK OVERCOAT paper is adjusted to 4.0 g/m$^2$, and a secondary color image (red) formed from 100% of a yellow toner and 100% of a magenta toner and a secondary color image (blue) formed from 100% of a cyan toner and 100% of a magenta toner, each image having a size of 5 cm×5 cm, are produced. The image density (L*) and color saturation ($c^*=(a^{*2}+b^{*2})^{0.5}$) thus obtained are measured. For the measurement, measurements are made at 10 sites randomly selected within the image area using X-RITE 939 (aperture 4 mm), and an average value is determined. The density results and the color saturation results are shown in Table 2.

The evaluation is carried out based on the following criteria.

(Red Image Density)

G5: Less than 40

G4: Equal to or greater than 40 and less than 42

G3: Equal to or greater than 42 and less than 44

G2: Equal to or greater than 44 and less than 46

G1: Equal to or greater than 46

For the red image density (L*), a smaller value corresponds to a higher density, and the grades G2 to G5 represent acceptable ranges.

(Red Chroma)

G5: Equal to or greater than 70

G4: Equal to or greater than 67 and less than 70

G3: Equal to or greater than 64 and less than 67

G2: Equal to or greater than 61 and less than 64

G1: Less than 61

For the red color saturation (c*), a larger value corresponds to a higher chroma, and grades G2 to G5 represent acceptable ranges.

(Blue Image Density)

G5: Less than 44

G4: Equal to or greater than 44 and less than 46

G3: Equal to or greater than 46 and less than 48

G2: Equal to or greater than 48 and less than 50

G1: Equal to or greater than 50

For the blue image density (L*), a smaller value corresponds to a higher density, and the grades G2 to G5 represent acceptable ranges.

(Blue Chroma)

G5: Equal to or greater than 79

G4: Equal to or greater than 76 and less than 79

G3: Equal to or greater than 73 and less than 76

G2: Equal to or greater than 70 and less than 73

G1: Less than 70

For the blue color saturation (c*), a larger value corresponds to a higher chroma, and grades G2 to G5 represent acceptable ranges.

TABLE 2

| | Simple color | | Secondary color (red) | | Secondary color (blue) | |
|---|---|---|---|---|---|---|
| | Density | Color saturation | Density | Color saturation | Density | Color saturation |
| Example 1 | G5 | G4 | G4 | G4 | G4 | G4 |
| Example 2 | G4 | G3 | G4 | G3 | G4 | G3 |
| Example 3 | G4 | G3 | G4 | G3 | G4 | G3 |
| Example 4 | G4 | G2 | G4 | G2 | G4 | G2 |
| Example 5 | G4 | G2 | G4 | G2 | G4 | G2 |
| Example 6 | G5 | G5 | G5 | G5 | G5 | G5 |
| Example 7 | G3 | G3 | G2 | G2 | G2 | G2 |
| Example 8 | G5 | G4 | G5 | G3 | G5 | G3 |
| Example 9 | G4 | G2 | G4 | G2 | G4 | G2 |
| Example 10 | G4 | G4 | G4 | G3 | G4 | G4 |
| Comp. Ex. 1 | G4 | G3 | G4 | G1 | G4 | G2 |
| Comp. Ex. 2 | G4 | G3 | G4 | G1 | G4 | G2 |
| Comp. Ex. 3 | G2 | G2 | G1 | G1 | G1 | G2 |
| Comp. Ex. 4 | G5 | G4 | G2 | G1 | G2 | G1 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A magenta toner consisting essentially of:

a binder resin containing a polyester resin having a dodecenylsuccinic acid structure as a constituent unit; and a solid solution consisting of C.I. Pigment Violet 19 and C.I. Pigment Red 122, wherein an amount of the solid solution in the magenta toner is from 2% by mass to 30% by mass based on a total mass of the toner, and a copolymerization ratio of the dodecenylsuccinic acid structure is from 5 mol % to 25 mol % based on 100 mol % of all acid-derived components of the polyester resin.

2. The magenta toner of claim 1, wherein a ratio in parts by mass of the C.I. Pigment Violet 19 and the C.I. Pigment Red 122 contained in the solid solution is from 80:20 to 20:80.

3. The magenta toner of claim 1, wherein the binder resin further contains a crystalline polyester resin in an amount of from 1% by mass to 10% by mass based on a total mass of the binder resin.

4. A toner set comprising:

the magenta toner of claim 1; and a yellow toner containing any one of C.I. Pigment Yellow 74, C.I. Pigment Yellow 180 or C.I. Pigment Yellow 185 as a colorant.

5. A toner set comprising:

the magenta toner of claim 1; and a cyan toner containing C.I. Pigment Blue 15 as a colorant.

6. A magenta developer comprising:

the magenta toner of claim 1; and a carrier.

7. A toner cartridge of an image forming apparatus comprising:

an accommodating portion which accommodates the magenta toner of claim 1 to supply the magenta toner to a toner image forming unit, wherein the toner cartridge is detachable from an image forming apparatus having an electrostatic latent image holding member configured to hold an electrostatic latent image formed on a surface thereof, the toner image forming unit that develops the electrostatic latent image formed on the surface of the electrostatic latent image holding member using a toner and thereby forming a toner image on the surface of the electrostatic latent image holding member, and a transfer unit that transfers the toner image to a recording medium.

8. A process cartridge of an image forming apparatus comprising:

an electrostatic latent image holding member configured to hold an electrostatic latent image formed on a surface thereof; and a toner image forming unit that accommodates the magenta developer of claim 6 and also develops the electrostatic latent image formed on the surface of the electrostatic latent image holding member using a toner to form a toner image on the surface of the electrostatic latent image holding member, wherein the process cartridge is detachable from an image forming apparatus.

9. An image forming apparatus comprising:

an electrostatic latent image holding member configured to hold an electrostatic latent image formed on a surface thereof;

a charging unit that charges the surface of the electrostatic latent image holding member;

an electrostatic latent image forming unit that forms an electrostatic latent image on the surface of the charged electrostatic latent image holding member;

a toner image forming unit that accommodates the magenta developer of claim 6 and also develops the electrostatic latent image formed on the surface of the electrostatic latent image holding member using a toner to form a toner image on the surface of the electrostatic latent image holding member;

a transfer unit that transfers the toner image to a recording medium; and a fixing unit that fixes the toner image transferred to the recording medium.

10. An image forming apparatus comprising:

the process cartridge of claim 8 that is detachable from the image forming apparatus, which has the electrostatic latent image holding member configured to hold an electrostatic latent image formed on the surface and the toner image forming unit that develops the electrostatic latent image formed on the surface of the electrostatic latent image holding member using a toner to form a toner image on the surface of the electrostatic latent image holding member;

a charging unit that charges the surface of the electrostatic latent image holding member;

an electrostatic latent image forming unit that forms an electrostatic latent image on the surface of the charged electrostatic latent image holding member;

a transfer unit that transfers the toner image to a recording medium; and a fixing unit that fixes the toner image transferred to the recording medium.

11. The magenta toner of claim 1, wherein the copolymerization ratio of the dodecenylsuccinic acid structure is from 7 mol % to 20 mol % based on 100 mol % of all acid-derived components of the polyester resin.

12. A magenta toner consisting essentially of:

a binder resin containing a polyester resin having a dodecenylsuccinic acid structure as a constituent unit;

a release agent; and a solid solution consisting of C.I. Pigment Violet 19 and C.I. Pigment Red 122, wherein an amount of the solid solution in the magenta toner is from 2% by mass to 30% by mass based on a total mass of the toner, and a copolymerization ratio of the dodecenylsuccinic acid structure is from 5 mol % to 25 mol % based on 100 mol % of all acid-derived components of the polyester resin.

13. The magenta toner of claim 12, wherein the release agent is a hydrocarbon-based wax having a melting temperature of equal to or higher than 60° C. and lower than 100° C.

14. The magenta toner of claim 12, wherein a ratio in parts by mass of the C.I. Pigment Violet 19 and the C.I. Pigment Red 122 contained in the solid solution is from 80:20 to 20:80.

* * * * *